US008313315B2

(12) United States Patent
Laing

(10) Patent No.: US 8,313,315 B2
(45) Date of Patent: Nov. 20, 2012

(54) CIRCULATING PUMP AND METHOD FOR PRODUCING A CIRCULATING PUMP

(75) Inventor: Karsten Laing, Althuette (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 892 days.

(21) Appl. No.: 11/804,708

(22) Filed: May 17, 2007

(65) Prior Publication Data

US 2007/0270008 A1 Nov. 22, 2007

Related U.S. Application Data

(63) Continuation of application No. PCT/EP2005/011861, filed on Nov. 5, 2005.

(30) Foreign Application Priority Data

Nov. 26, 2004 (DE) ..... 10 2004 058 593

(51) Int. Cl.
*F04B 35/04* (2006.01)

(52) U.S. Cl. ..... 417/423.14; 417/424.2

(58) Field of Classification Search ..... 417/423.1, 417/423.14, 424.1, 424.2; 277/604, 609, 277/614, 616, 637, 641; 285/91, 133.11, 285/133.21, 133.3, 190, 192, 403, 404
See application file for complete search history.

(56) References Cited

U.S. PATENT DOCUMENTS

| | | | | |
|---|---|---|---|---|
| 3,306,222 | A * | 2/1967 | Simcox | 417/357 |
| 3,457,868 | A * | 7/1969 | Eaton | 415/151 |
| 3,490,379 | A * | 1/1970 | Laing | 417/420 |
| 3,824,035 | A | 7/1974 | Laing | |
| 4,834,628 | A * | 5/1989 | Laing | 417/420 |
| 4,874,300 | A * | 10/1989 | Laing et al. | 417/420 |
| 5,618,168 | A * | 4/1997 | Moon | 417/423.11 |
| 6,082,976 | A * | 7/2000 | Kempf et al. | 417/423.14 |
| 6,149,407 | A * | 11/2000 | Laing | 417/423.14 |
| 2002/0041814 | A1 * | 4/2002 | Casper et al. | 417/423.14 |
| 2004/0119371 | A1 | 6/2004 | Laing | |
| 2004/0256854 | A1 * | 12/2004 | Haunhorst et al. | 285/133.11 |
| 2005/0163627 | A1 * | 7/2005 | Morris et al. | 417/244 |
| 2005/0196274 | A1 | 9/2005 | Kraffzik | |

(Continued)

FOREIGN PATENT DOCUMENTS

DE 26 40 374 3/1978

(Continued)

OTHER PUBLICATIONS

Abstract for DE2640374.*

(Continued)

*Primary Examiner* — Devon Kramer
*Assistant Examiner* — Dnyanesh Kasture
(74) *Attorney, Agent, or Firm* — Lipsitz & McAllister, LLC

(57) ABSTRACT

To provide a circulating pump, comprising a housing, in which a pumping space is arranged, a suction connector, which is in fluid connection with the pumping space, and a pressure connector, which is in fluid connection with the pumping space, which can be produced in a simple manner and can be used in a reliable manner, wherein the suction connector and/or pressure connector are formed on at least one connector element, which is a separate part from the housing, and wherein the connector element is fixed to the housing, it is proposed that the housing have a fixing region for fixing the at least one connector element, which is arranged above the pumping space.

29 Claims, 28 Drawing Sheets

U.S. PATENT DOCUMENTS

2005/0201878 A1 9/2005 Kraffzik

FOREIGN PATENT DOCUMENTS

| | | | |
|---|---|---|---|
| DE | 2640374 | * | 3/1978 |
| DE | 40 31 164 | | 4/1992 |
| DE | 102 45 015 | | 5/2003 |
| DE | 20 2004 011 980 | | 10/2004 |
| EP | 1 416 607 | | 5/2004 |
| FR | 1 177 409 | | 4/1959 |
| GB | 476 246 | | 12/1937 |

OTHER PUBLICATIONS

DE 2640374, Unofficial English Translation,Translated on Sep. 2, 2010, http://epo.worldlingo.com/wl/epo/epo.html?ACTION=description-retrieval&OPS=ops.epo.org&LOCALE=en_EP&FORMAT=docdb&COUNTRY=DE&NUMBER=2640374&KIND=A1&T=1.*

* cited by examiner

CIRCULATING PUMP AND METHOD FOR PRODUCING A CIRCULATING PUMP

This application is a continuation of international application number PCT/EP2005/011861 filed on Nov. 5, 2005.

The present disclosure relates to the subject matter disclosed in international application number PCT/EP2005/011861 of Nov. 5, 2005 and German application number 10 2004 058 593.8 of Nov. 26, 2004, which are incorporated herein by reference in their entirety and for all purposes.

BACKGROUND OF THE INVENTION

The invention relates to a circulating pump comprising a housing, in which a pumping space is arranged, a suction connector, which is in fluid connection with the pumping space, and a pressure connector, which is in fluid connection with the pumping space, wherein the suction connector and/or pressure connector are formed on at least one connector element, which is a separate part from the housing and wherein the connector element is fixed to the housing.

The invention also relates to a method for producing a circulating pump, in which there is produced at least one connector element with a suction connector and/or pressure connector, a housing of the circulating pump is produced and the at least one connector element is fixed to the housing.

A circulating pump is known from U.S. Pat. No. 6,082,976 A, in which a distributor is coupled to a pump housing by means of coupling means and a motor is placed on the pump housing. The pump housing is held clamped between the motor and the distributor, the coupling means penetrating the pump housing in order to be able to act on the motor, in order to in turn be able to press the latter against the pump housing.

SUMMARY OF THE INVENTION

In accordance with the invention, a circulating pump is provided, which can be produced in a simple manner and can be used in a reliable manner.

In accordance with an embodiment of the invention, the circulating pump has a housing with a fixing region for fixing the at least one connector element, which is arranged above the pumping space.

A circulating pump must be connected for use to a system. In the case of a connection of this type, in principle, large forces can be exerted. In the solution according to the invention, the connector element is provided as a force-absorbing element. This may be configured such that it can absorb the corresponding forces. In particular, it is produced from a metallic material. It is possible, owing to the separation between the connector element and the housing, to produce the housing from a plastics material and, in particular, from a thermoplastic plastics material. The housing itself absorbs no forces or substantially lower forces with respect to the connection than when the connection takes place by means of the housing. The at least one connector element is provided instead of the connection by means of the housing.

This in turn makes it possible, as the housing can be produced from a plastics material, with its easy formability, for the housing to be configured, in particular with respect to the pumping space, in such a way that a high degree of efficiency is achieved. (The forming possibilities, for example in the case of a cast iron housing are very limited in comparison to a plastics material housing.)

It is provided that the housing has a fixing region for fixing the at least one connector element, which is arranged above the pumping space. Thus the housing below the fixing region has no holding function with respect to the at least one connector element, in other words the at least one connector element can be held on the housing solely by means of the fixing region. The housing below the fixing region can thus be configured in such a way that simple production and/or an optimised mode of functioning is made possible. In particular, one or more side walls, between which the pumping space is formed, can be configured so as to be relatively thin; no fixing elements have to be guided through these side walls, as the fixing region completely ensures the fixing of the at least one connector element. In particular, these walls can then be configured so as to be "thin". For example, it is then also possible to arrange an electric motor in the housing of the pump.

The fixing region is arranged above the pumping space with respect to an axial direction, (which is, in particular, coaxial to a rotational axis of a pump impeller) and does not extend into the pumping space. The fixing region is spaced apart, in particular, from an electric motor and the fixing region has no function for fixing the electric motor to the housing.

Owing to the solution according to the invention, a circulating pump can be produced in a simple and economical manner, which can be connected without disruption to a system, even when high forces are exerted on the connector element. The housing may, however, separately from the connector element, be optimised in such a way that a high degree of efficiency is produced.

It is quite particularly advantageous if the at least one connector element is held on the housing completely by means of the fixing region. No adaptation or modification of the housing with regard to a necessary fixing of the at least one connector element is thus then necessary below the pumping space.

It is furthermore advantageous if the at least one connector element rests on the fixing region and/or the fixing region rests on the at least one connector element. In particular, the at least one connector element rests on solid material of the fixing region, this being, in particular, a solid plastics material. Fixing can thus made possible in a simple and reliable manner.

It is favourable if the at least one connector element is a pipe or a pipe connection piece. A pipe or a pipe connection piece of this type can be produced in a simple and economical manner.

It is quite particularly advantageous if a common connector element is provided for the suction connector and the pressure connector. The circulating pump can thus be produced in a simple and economical manner. In particular, only one connector element has to be fixed to the housing.

The suction connector and the pressure connector can be configured on a common connector element if a suction connector region and a pressure connector region are separated by a wall, specifically are separated in a liquid-tight manner. Thus liquid can be removed between the suction connector and the pressure connector, the flow being guided through the pumping space.

In particular, the at least one connector element has at least one opening for connection to the pumping space. Through this opening, liquid from the connector element can be introduced into the pumping space or liquid can be removed from the pumping space through the opening by means of the connector element.

The at least one opening can be produced in a simple manner by stamping.

It is quite particularly advantageous if the at least one connector element is produced from a metallic material. For example, it is produced from steel, high-grade steel or brass. Cast iron connector elements are also possible. Such connector elements may absorb large forces and, in particular, large shearing forces. Such large forces may occur when the circulating pump is connected by means of its connector element to a system, such as, for example, a heating system. In the case of a connection of this type, tools, such as, for example, pipe wrenches, are used.

The at least one connector element advantageously extends along an axis, which is located transverse to the rotational axis of a pump impeller. Suction connectors and pressure connectors can thus be provided, which are easily accessible. Furthermore, a connection opening to the pumping space can be produced in a simple manner.

It is particularly advantageous if the at least one connector element has a greater length along its axis of extent than the housing. The connector element thus preferably projects with its suction connector and with its pressure connector beyond the housing. This achieves easy accessibility of the suction connector and the pressure connector for a system attachment.

It is advantageous if one or more seals are arranged between the at least one connector element and the housing. It is thus ensured that liquid introduced via the suction connector runs through the pumping space of the circulating pump completely and the introduced liquid quantity is completely removed.

It may be provided that the housing has one or more recesses for the respective receiving of the seal. Such recesses can be produced integrally with the production of the housing.

It is alternatively or additionally possible for the at least one connector element to have one or more recesses for the respective receiving of a seal. For example, a recess of this type may be produced in a high-grade steel pipe by embossing. A recess of this type may be milled into a cast iron pipe.

It may be provided that at least one seal is arranged about an axis of the connector element. This allows a seal to be achieved between the connector element and the housing. For this purpose, for example, conventional O-rings may be used.

It may also be provided that at least one seal is arranged between a housing region, which limits the pumping space, and the connector element. A seal of this type ensures sealing in the region of openings of the pumping space.

At least one seal may be arranged, in this case, on an opening of the connector element into the pumping space. The opening is thus directly sealed.

It is basically possible for each opening to be associated with its own seal. However, it may also be provided that a common seal for the openings into the pumping space is provided for the suction connector and the pressure connector. The number of seals may thus be reduced.

It is quite particularly advantageous if the housing is produced from a plastics material. The housing may thus be provided with basically any form. The housing is then preferably configured in such a way that a high degree of efficiency is produced. A high degree of efficiency can be achieved, in particular, by a corresponding configuration of the pumping space.

It is quite particularly advantageous if the housing has a receiving space for an electric motor. This allows an integral housing to be produced, in which the pumping space is formed and in which an electric motor can be positioned. In particular when the electric motor has a low axial overall height, the heat loading of the housing is not a problem in the region of the electric motor (as heat can be dissipated by means of the pump liquid). A plastics material can then be used for the housing even in the region of the electric motor.

It is particularly advantageous if at least one pin connection, for example in the form of a latching connection, is provided to fix the at least one connector element on the housing with regard to the direction of extent of the connector element. By encompassing the connector element by a fixing region of the housing, the connector element can be fixed radially to the housing. An axial fixing (based on a transverse axis to the radial direction) may also be ensured by the at least one pin connection. For example it is thus possible to insert a connector element into a fixing region until the pin connection is produced. This allows simple production of the circulating pump.

In one embodiment, the at least one connector element is connected to the fixing region by one or more screws or bolts or the like. As the main forces are absorbed by the connector element, the forces, which the housing has to absorb, are reduced in comparison to the case in which the connector element is an integral housing component. The connections therefore experience lower forces. An adequate security of the connection is ensured by screws or bolts.

In particular, the screws or bolts are arranged above the pumping space. The fixing region provides a corresponding receiving region or receiving regions for the screws or bolts, into which these may project. The fixing of the at least one connector element is thus brought about solely by means of the fixing region above the pumping space.

It is also favourable if the fixing region has one or more receiving regions for screws or bolts, which, with respect to side walls of the pumping space, are arranged offset toward an axis of the pumping space. In the solution according to the invention, the at least one connector element is held solely by means of the fixing region above the pumping space. A large coupling region can thus be provided between the screws and bolts on the fixing region, this coupling region being provided in particular by means of a solid material region, for example made of a plastics material. As the screws or bolts or the like do not have to be guided through one or more side walls of the pumping space, an offset arrangement is possible, so the connection strength can in turn be increased.

It may be favourable if the at least one connector element has one or more brackets for fixing to the fixing region. The connector element can be fixed by screws or bolts to the housing by means of the brackets. It is also possible to hold the connector element so as to be clamped on the housing by means of a bracket of this type, with it being possible for integral housing parts to exert a clamping effect.

In one embodiment, the at least one connector element is held on the housing, clamped by means of at least one bracket, the housing having one or more elastic elements, which exert a clamping force on the brackets and therefore on the connector element.

It may also be provided that the at least one bracket is embedded in the fixing region. In particular, the at least one bracket is moulded around; when producing the housing by means of injection moulding, the connector element is positioned in the corresponding mould and moulded around.

It may be provided that the fixing region surrounds the at least one connector element. Thus the connector element can be held by clamping and it can be embedded in the housing.

In one embodiment, the fixing region is of multi-part configuration. Thus at least one connector element can be fixed to the housing in a simple manner; for example, it is placed in one part and a second part is then fixed to the first part in order to thus fix the connector element between the two parts.

In particular, the at least one connector element is held so as to be clamped between two opposing parts, the parts being connected to one another, for example by screw connections or bolt connections.

It may also be provided that the fixing region is configured in one piece, the at least one connector element then advantageously being embedded in the fixing region. In particular, the at least one connector element has plastics material of the housing moulded around it at the fixing region.

It may also be provided that the at least one connector element is held on the fixing region by means of one or more wedge elements. The wedge elements ensure a clamping of the connector element at the fixing region.

In particular, the at least one clamping element is arranged between the fixing region and the at least one connector element.

It is favourable if the at least one connector element is cylindrical in configuration. Such connector elements are available. No special connector element has to be manufactured in order to allow a connection. In particular, a connector element prebody does not have to be provided with a flattened area, for example, in order to be able to connect it at all to the housing. In particular, when the connector element is surrounded by the fixing region, a cylindrical connector element may be fixed in a simple manner to the housing, for example by being moulded around or by clamping.

In accordance with the invention, a method for producing a circulating pump is provided, which can be carried out in a simple manner.

In accordance with an embodiment of the invention, at least one connector element is fixed on a fixing region above a pumping space.

In the method in accordance with the invention, a separation results between the connector element and the housing. The connector element can be optimised as a force-absorbing part with respect to its connection function and the housing may be optimised with respect to its pumping function.

The total product, the circulating pump can be optimised by the separate optimisability.

In particular, the housing is produced from a plastics material. In the solution according to the invention it is specifically possible to use a plastics material for producing the housing.

It is quite particularly favourable if the at least one connector element is produced from a metallic material. The connector element may thus absorb large forces, such as may occur during the system integration of the circulating pump to an application by means of the connector element.

It may be provided that the at least one connector element, after production of the housing, is fixed thereto, for example by screwing or clamping.

Alternatively, it is possible for the at least one connector element to be fixed during production of the housing, for example in that the at least one connector element is at least partially moulded around.

The at least one connector element is favourably fixed by means of a latching connection to the housing, this fixing in particular applying to a direction parallel to an axis of the connector element. This results in simple producibility for the circulating pump according to the invention.

The following description of preferred embodiments is used for more detailed description of the invention in conjunction with the drawings.

DETAILED DESCRIPTION OF THE INVENTION

Figure 1:
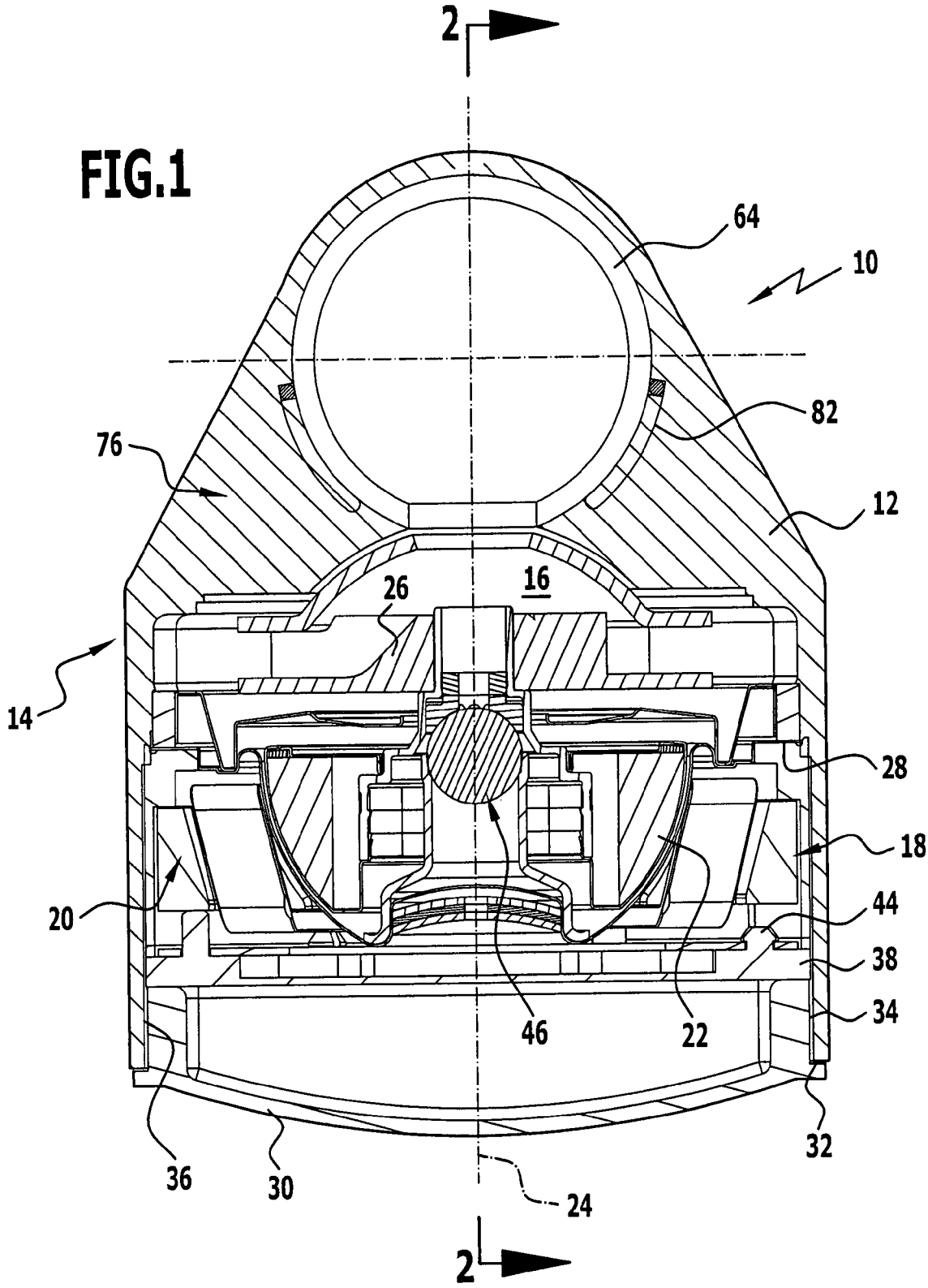
FIG. 1 shows a sectional view of a first embodiment of a circulating pump according to the invention.
Figure 2:
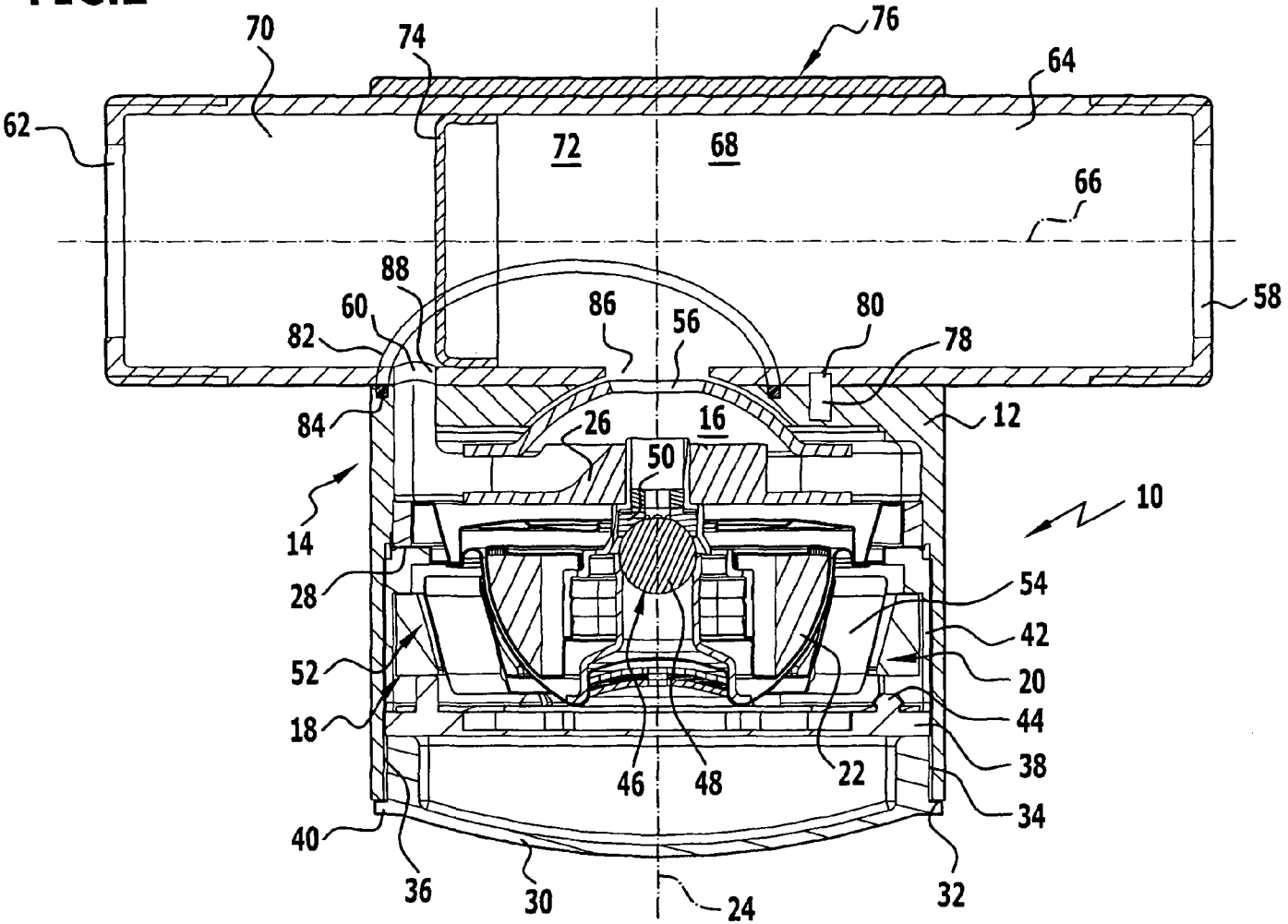
FIG. 2 shows a sectional view of the circulating pump according to FIG. 1 along the line 2-2.

A first embodiment of a circulating pump according to the invention, which is shown in FIGS. 1 and 2 and designated there by 10, comprises a housing 12. The housing 12 has a pump part 14, in which a pumping space 16 and a receiving space 18 for an electric motor 20 are formed.

The electric motor 20 has a rotor 22, which can be rotated about a rotational axis 24. The pumping space 16 and the receiving space 18 for the electric motor 20 follow one another axially with respect to this rotational axis 24. An axis of the pumping space 16 coincides with the rotational axis 24.

A pump impeller 26 is fixed to the rotor 22 for rotation therewith, the pump impeller 26 being rotatably seated in the pumping space 16.

The pump part 14 of the housing 12 is configured in one piece. It comprises a shoulder 28, by which a contact face for the electric motor 20 is provided.

The receiving space 18 for the electric motor 20 is closed, for example, by a stopper-like holding element 30. This holding element is used as a lid to close the housing 12 at one end 32, which is remote from the pumping space 16.

The holding element 30 is also used for axial fixing (with respect to the rotational axis 24) of the electric motor 20 in the receiving chamber 18. For this purpose, the holding element 30 has an outer thread 34 and the housing 14 on the receiving space 18 has a matched inner thread 36. The holding element 30 is screwed by its outer thread 34 onto the housing 12. It thus provides a contact face 38, which is in particular annular, for the electric motor 20. The electric motor 20 can thus be axially fixed, in that it is clamped between the contact face of the shoulder 28 and the contact face 38 of the holding element 30, in other words is clamped between these two contact faces.

The holding element 30 may have a flange 40, which has a greater diameter than the internal diameter of the housing 12 in the receiving space 18, to ensure a seal.

The electric motor 20 has a motor housing 42, which rests on an inner side of walls forming the pump part 14 of the housing 12. The electric motor 20 can thus also be positioned and fixed transversely to the rotational axis 24 (in other words radially) in the housing 12.

It may be provided that the motor housing 42 is held by means of one or more pins 44 on the remaining motor, the pins 44 being oriented in particular substantially parallel to the rotational axis 32. In this case, the holding element 30 is supported on the electric motor 20 by means of the motor housing 42.

The electric motor 20 comprises a spherical bearing 46, by means of which the rotor 22 is spherically mounted. For this purpose, the spherical bearing 46 has a spherical sliding body 48, which is produced, in particular from a ceramic material. The rotor 22 is non-rotationally connected to a bearing shell 50 matched to the sliding body 48. The bearing shell 50 slides on the sliding body 48.

The rotor 22 is configured, in particular, to generate a magnetic field and has one or more permanent magnets.

The electric motor 20 also has a stator 52 with a magnetic return body 54. This magnetic return body 54 surrounds the rotor 22 annularly.

The rotor 22 is configured spherically facing the stator 52. The stator 52 is configured spherically facing the rotor 22.

Corresponding electric motors, which can be configured with a low axial overall height, are disclosed in EP 1 416 607 A2 and DE 102 45 015 A1. Reference is expressly made to these documents.

The pumping space 16 has a first opening 56, via which liquid can be introduced into the pumping space 16. This first opening 56 is in fluid connection with a suction connector 58 of the circulating pump. The first opening 56 defines a suction side of the circulating pump 10.

The pumping space 16 also has a second opening 60, via which liquid can be removed. The second opening 60 is in fluid connection with a pressure connector 62 of the circulating pump 10. The second opening 60 defines a pressure side of the circulating pump 10.

The suction connector 58 and the pressure connector 62 are formed on a connector element 64. This connector element 64 is an element produced separately from the housing 12. It is configured, in particular, in the form of a pipe connection piece.

The connector element extends along an axis of extent 66. This axis of extent is located transversely and in particular perpendicularly to the rotational axis 24 of the rotor 22.

The connector element 64 is produced from a metallic material. For example, it is made of steel, high-grade steel or brass. It may also be a cast iron pipe.

The connector element 64 has a suction connector region 68, by means of which liquid can be guided from the suction connector 58 to the first opening 56. Furthermore, the connector element 64 has a pressure connector region 70, by means of which liquid coming from the second opening 60 can be removed via the pressure connector 62.

The connector element 64 is used for connecting the circulating pump 10 to a system environment such as, for example, a heating system.

The suction connector region 68 and the pressure connector region 70 are separated by a wall 74 arranged in an inner space 72 of the tubular connector element 64. This wall is fixed in the inner space 72 for example by welding. The wall 74 and the fixing are liquid-tight, so liquid from the suction connector 58 can reach the pressure connector 62 only by crossing the pumping space 16.

The housing 12 has a fixing region 76, which is used for fixing the connector element 64 to the housing 12. In the first embodiment 10, this fixing region 76 is connected in one piece with the pump part 14 of the housing.

The fixing region 76 surrounds the connector element 64. In particular, the connector element 64 is embedded in the fixing region 76.

The housing 12 is produced from a plastics material such as PA6.6 or PPS. It can be produced, in particular, by an injection moulding method. It may be provided that the connector element 64 is fixed and is moulded around during the production of the housing in a corresponding injection moulding mould.

The fixing region 76 is approximately triangular in cross-section with a rounded tip (FIG. 1). A wide connection to the pump part 14 can thus be achieved by the fixing region 76 with a low outlay for material.

The connector element 64 has a preferably cylindrical design and preferably has a circular cross-section. The axis of extent 66 is then a cylinder axis, the rotational axis 24 preferably intersecting this axis of extent 66.

The connector element 64 is longer along the axis of extent 66 than the pump part 14 of the housing (FIG. 2). The suction connector 58 and the pressure connector 62 are thus arranged, in each case, projecting beyond the pump part 14 of the housing 12. This provides sufficient space for a connection of pipes or the like.

One or more pins 78 may be provided for fixing in the direction of the axis of extent 66 and are arranged on the pump part 14 of the housing 12 and project into a recess 80 on the connector element 64.

It is possible for the pin connection between the connector element 64 and the housing 12 to take place during production of the housing. However, it is basically also possible for the pin connection to be produced retrospectively; for example, the fixing region 76 has a recess, into which the connector element 64 can be inserted. In this case, the pin 78 is arranged and configured resiliently. The insertability of the connector element is thus ensured. If one or more recesses 80 then reach their associated pin or pins, the latter may then project into the recess or recesses to thus ensure fixing of the connector element with respect to the extension direction 66.

The fixing region 76 of the housing 12 ensures a radial fixing of the connector element 64, with respect to the axis of extent 66, on the housing 12.

To seal the transition between the connector element 64 and the pump part 14, a seal 82 is provided. In the embodiment shown in FIG. 1, a groove-shaped recess 84 is formed in the pump part 14, which recess jointly surrounds the first opening 56 and the second opening 60, in other words the first opening 56 and the second opening 60 are located in an inner region of the recess 84 (which forms a closed curve). The first opening 56 and the second opening 60 can thus be sealed by a common seal 82.

The connector element 64 is the force-absorbing part during the installation of the circulating pump 10. Further pipes are connected thereto by means of the suction connector 58 and the pressure connector 62, in fact often with a high expenditure of force.

As the connector element 64 is the force-absorbing part of the circulating pump 10 (and therefore the housing 12 only has to absorb much less force), the connector element 64 is produced of metal. It has a first opening 86, which is in fluid connection with first opening 56 of the pumping space 16. Furthermore, it has a second opening 88, which is in fluid connection with the second opening 60 of the pumping space 16. The two openings 86 and 88 may be produced, for example, by stamping. Liquid may be introduced into the pumping space 16 and liquid removed from the pumping space 16 via these openings 86 and 88 via the connector element 64.

Since the connector element 64 is produced as a force-absorbing part from metal and the housing 12 thus has to absorb much lower forces, the housing 12 may be produced from a material, and in particular from a thermoplastic plastics material. It is thus in turn possible to optimise the housing 12 with respect to its shape, in particular with regard to the pumping space 16, in such a way that a high degree of efficiency is achieved. In the case of housings manufactured, for example, from cast iron, there are strong limitations with regard to the choice of shape.

It is also possible to produce the pump part 14 of the housing from a plastics material owing to the low axial overall height of the electric motor 20. Owing to the all-over connection of the holding element 30 to the housing 12, no or only low shearing stresses occur, so a connection, which is "suitable for a plastics material", of the holding element 30 to the housing 12, is achieved. Furthermore, heat can be removed effectively from the stator 52 by means of liquid, which flows through the pump space 16. It is thus possible to produce the housing 12 from a plastics material.

The circulating pump 10 according to the invention can be produced simply and economically. For this purpose, the connector element 64 is produced separately, for example in form of a pipe socket. It is then fixed to the housing 12 or a fixing takes place by means of the fixing region 76 during the production of the housing.

The connector element 64 is completely held on the housing 12 by means of the fixing region 76, the fixing region 76 being located above pumping space 16. The side walls of the housing 12 by means of which the pumping space 16 and the receiving space 18 are formed, thus do not have to be modified in order to absorb fastening elements for the connector element 64. The fixing region 76 is, for example, a solid material region or a region that is provided with reinforcement ribs, with free spaces.

Figure 3:
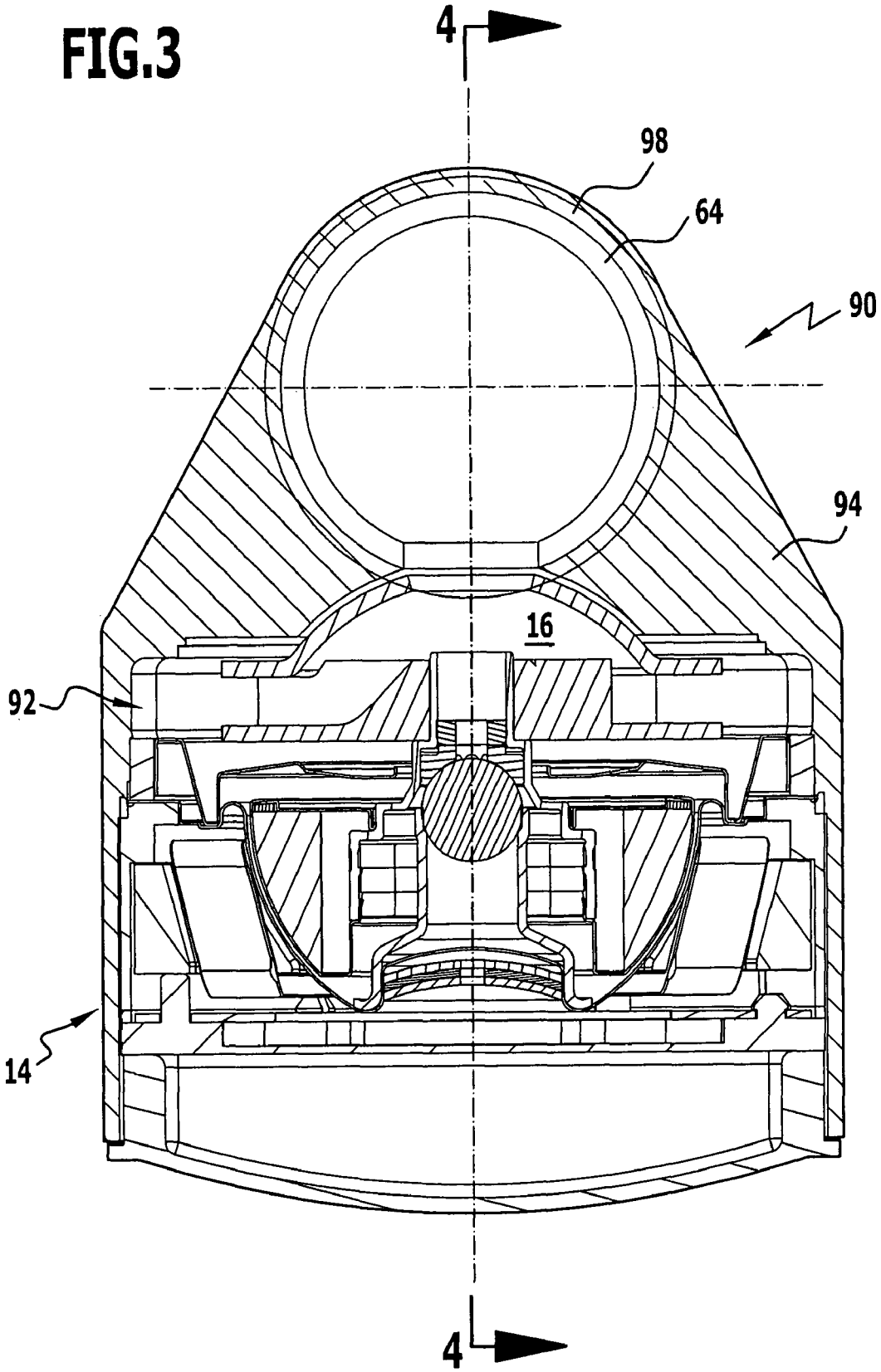
FIG. 3 shows a sectional view of a second embodiment of a circulating pump according to the invention.
Figure 4:
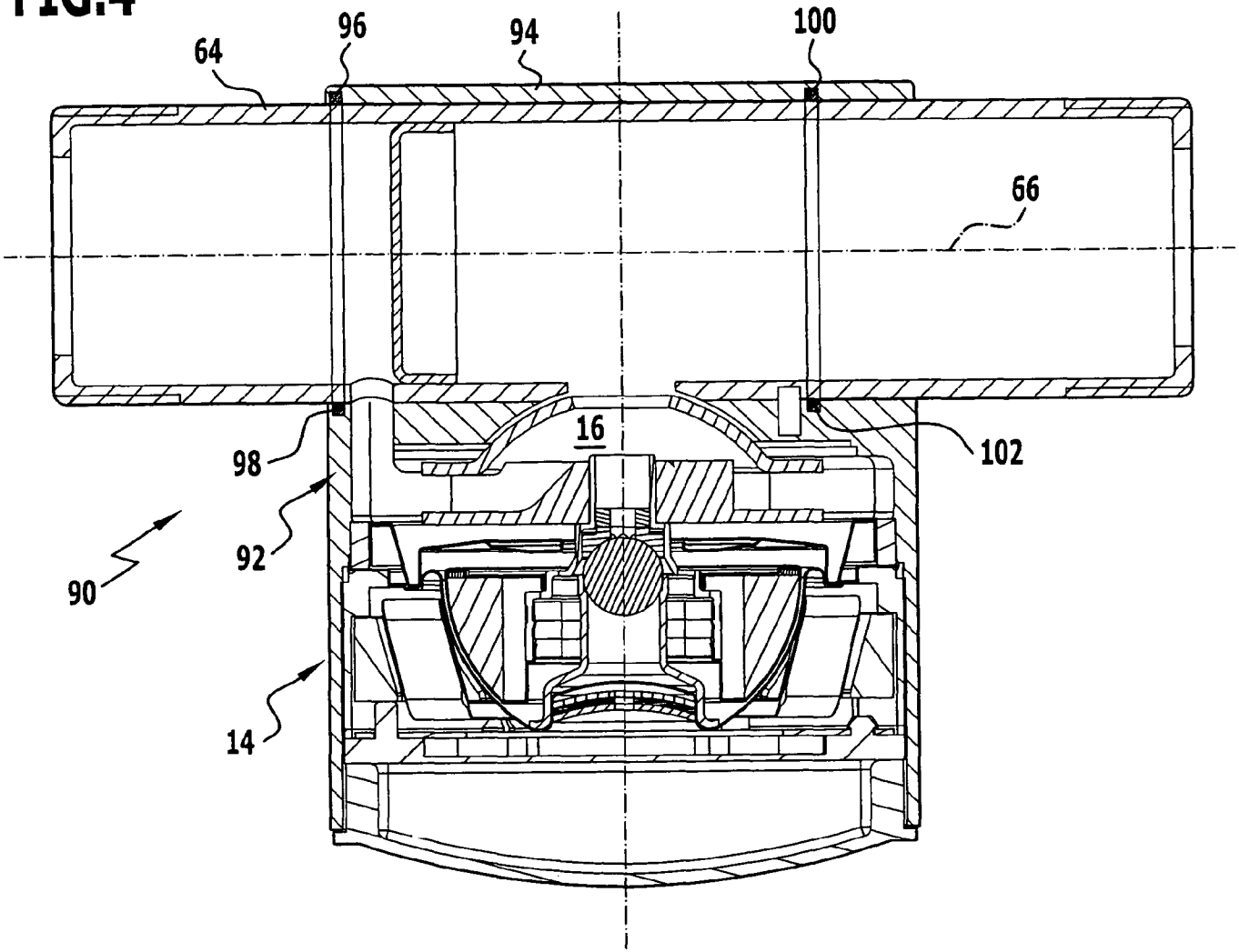
FIG. 4 shows a sectional view of the circulating pump according to FIG. 3 along the line 4-4.

In a second embodiment, which is shown in FIGS. 3 and 4 and designated 90 there, a housing 92 is provided with a pump part, which is basically configured the same as the pump part 14 of the circulating pump 10. The same reference numerals are therefore used for the pump part 14 in FIGS. 3 and 4 as in FIGS. 1 and 2. The connector element is also basically configured the same as described above, so the same reference numerals are used.

The connector element 64 is in turn fixed by means of a fixing region 94, which is basically configured the same as the fixing region 76 in the first embodiment.

The embodiment 90 differs from the embodiment 10 by the sealing arrangement and the configuration of the seals: a first seal 96 in particular in the form of an O-ring is provided, which is arranged in an in particular, groove-shaped first recess 98 of the fixing region 94. The first seal 96 surrounds the connector element 64. In particular, the seal 96 is oriented here transversely to the axis of extent 66 of the connector element 64. The first seal 96 is arranged in such a way that a pressure side of the pump space 16 can be sealed.

Furthermore, a second-seal 100 is provided, which is configured for example in the form of an O-ring. This second seal 100 is seated in a groove-shaped recess 102 which is formed in the fixing region 94. The second seal 100 is spaced apart in parallel from the first seal 96. It also surrounds the connector element 64.

Otherwise, the circulating pump 90 functions like the circulating pump 10.

Figure 5:
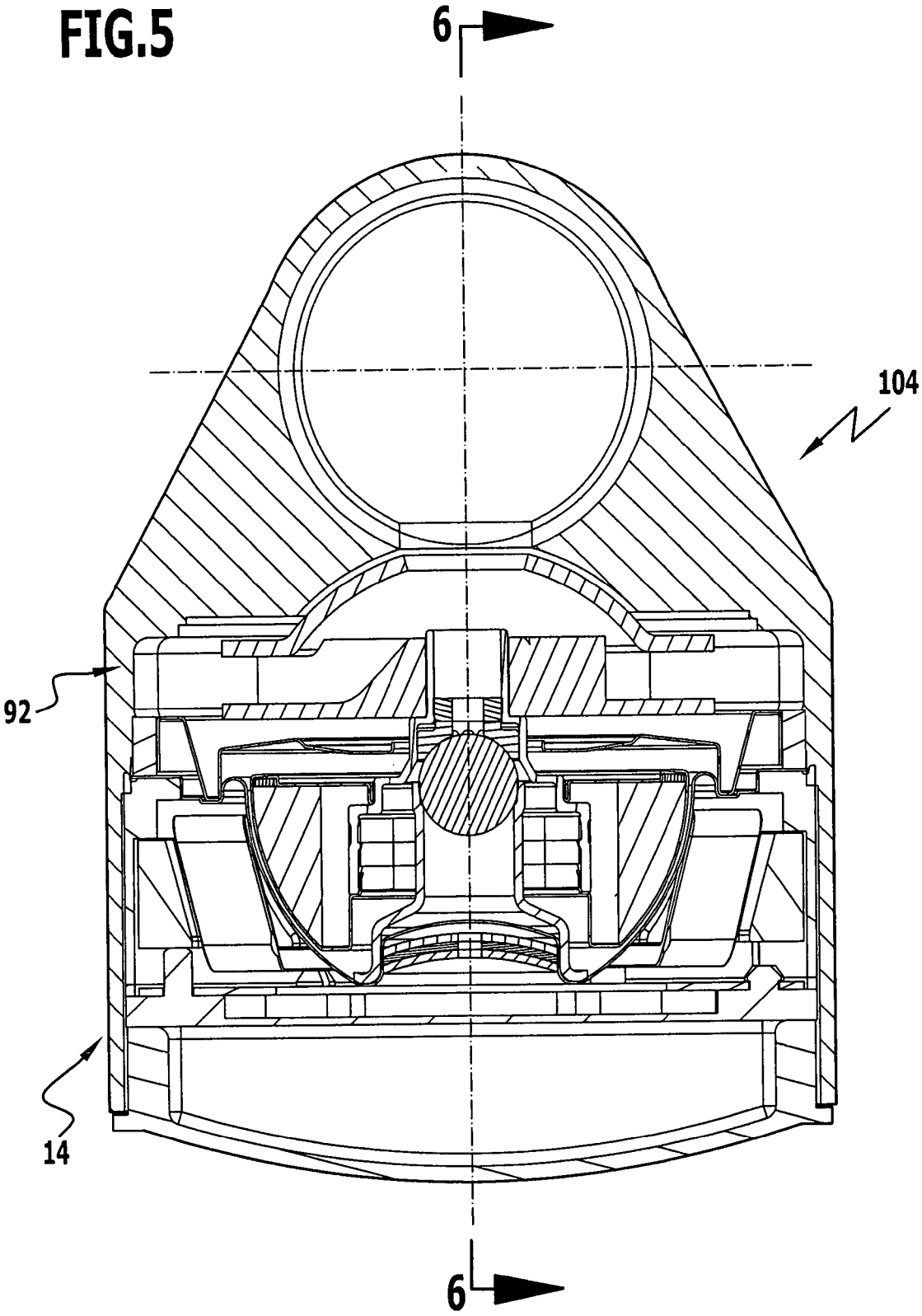
FIG. 5 shows a sectional view of a third embodiment of a circulating pump according to the invention.
Figure 6:
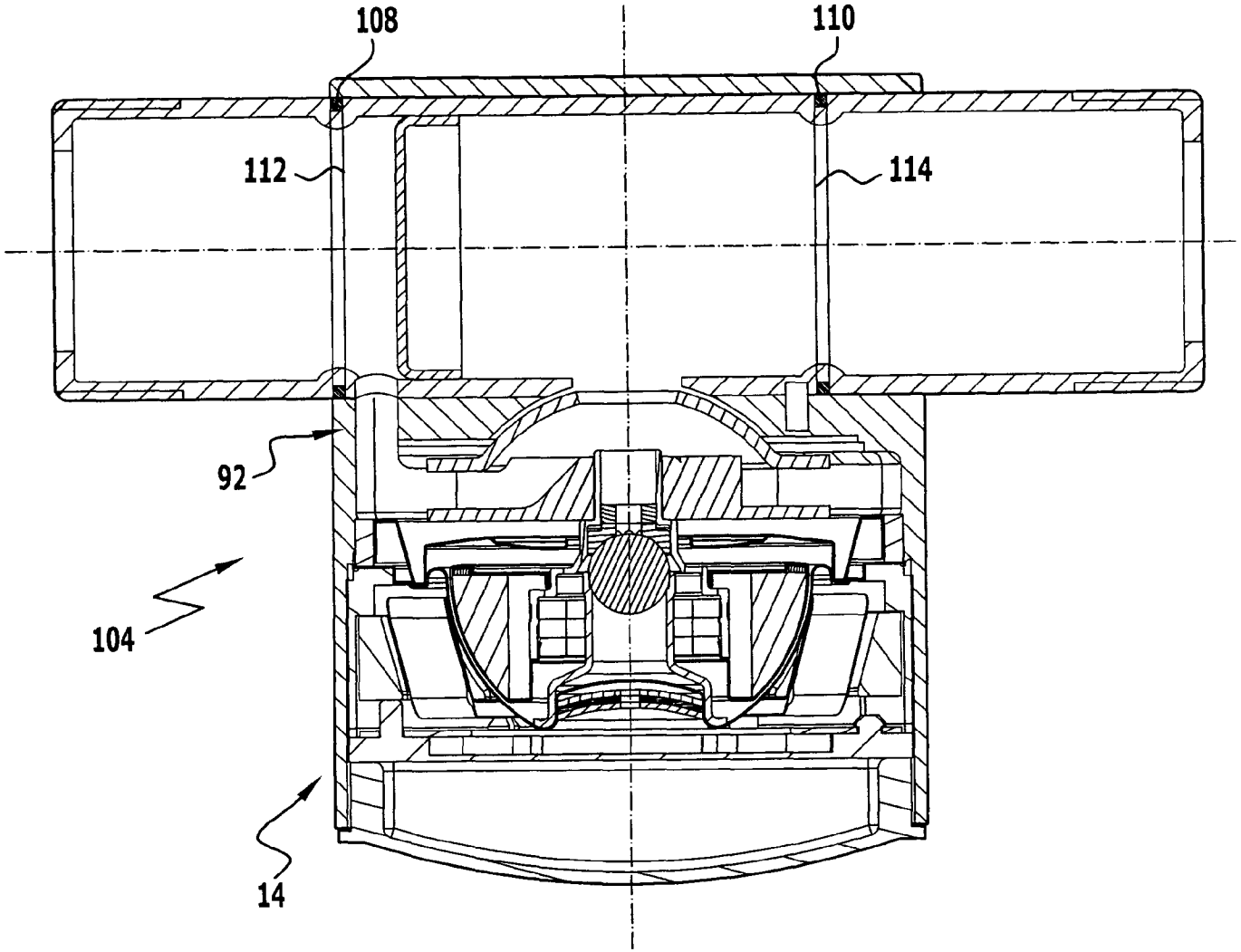
FIG. 6 shows a sectional view of the circulating pump according to FIG. 5 along the line 6-6.

In a third embodiment, which is shown in FIGS. 5 and 6 and designated 104 there, a connector element 106 is provided, which is basically configured the same as the connector element 64. However, the connector element 106 has a first peripheral groove-shaped recess 108 and a second peripheral groove-shaped recess 110. A corresponding wall of the connector element 106 may have a thickening or a bulge in the region of the recess 108 and 110. The recesses 108, 110 are formed, in this case, on an outer side of the connector element 106.

Respective first and second seals 112, 114 can be inserted in the recesses 108, 110 and have the same function as the seals 96 and 100 of the circulating pump 90. The difference is that the groove-shaped recesses of the seals are not formed on the housing but on the connector element 106.

Moreover, the housing is configured the same in the third embodiment 104 as the housing 92 in the second embodiment. The same reference numerals are therefore used in this respect.

Figure 7:
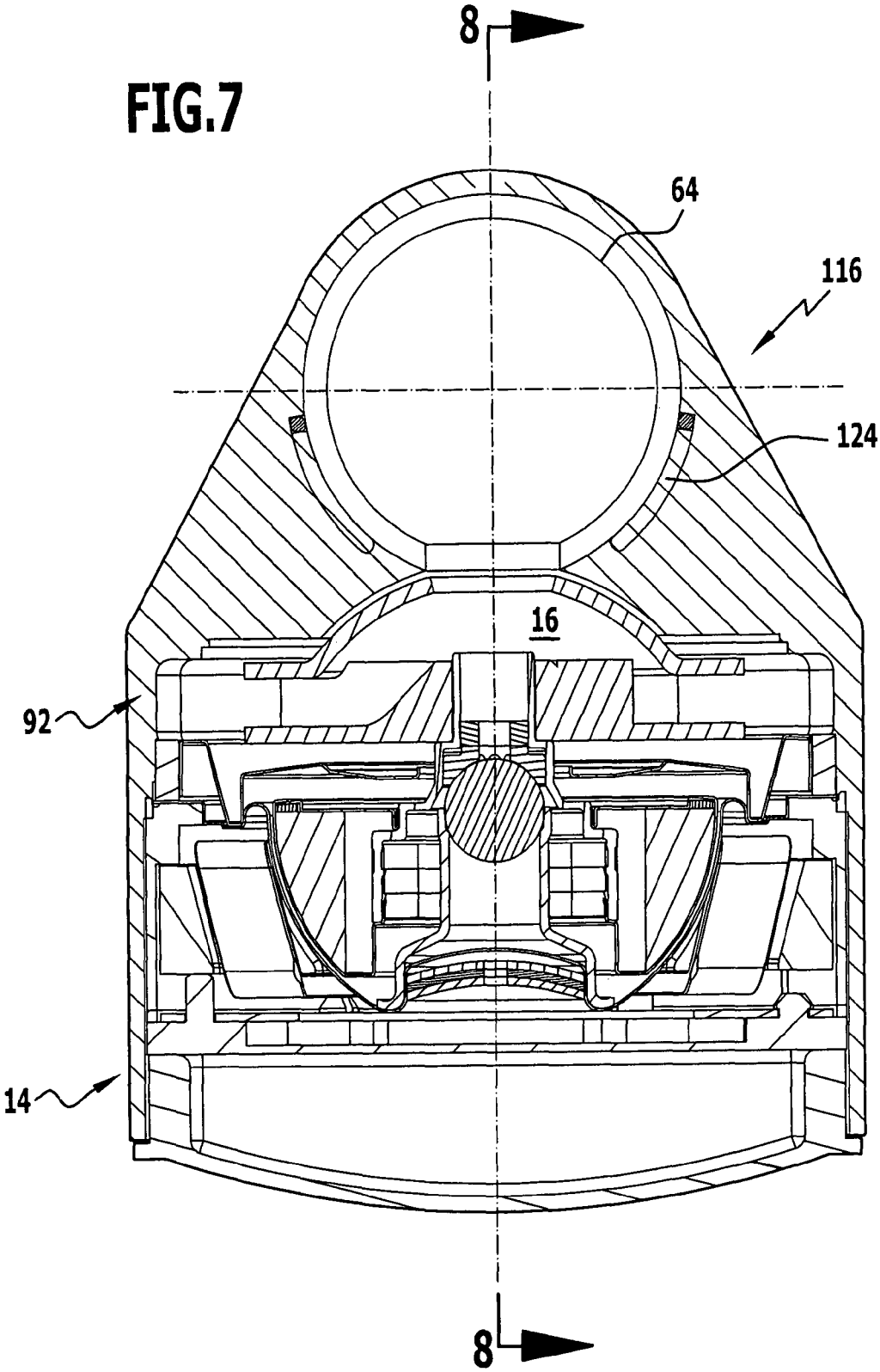
FIG. 7 shows a sectional view of a fourth embodiment of a circulating pump according to the invention.
Figure 8:
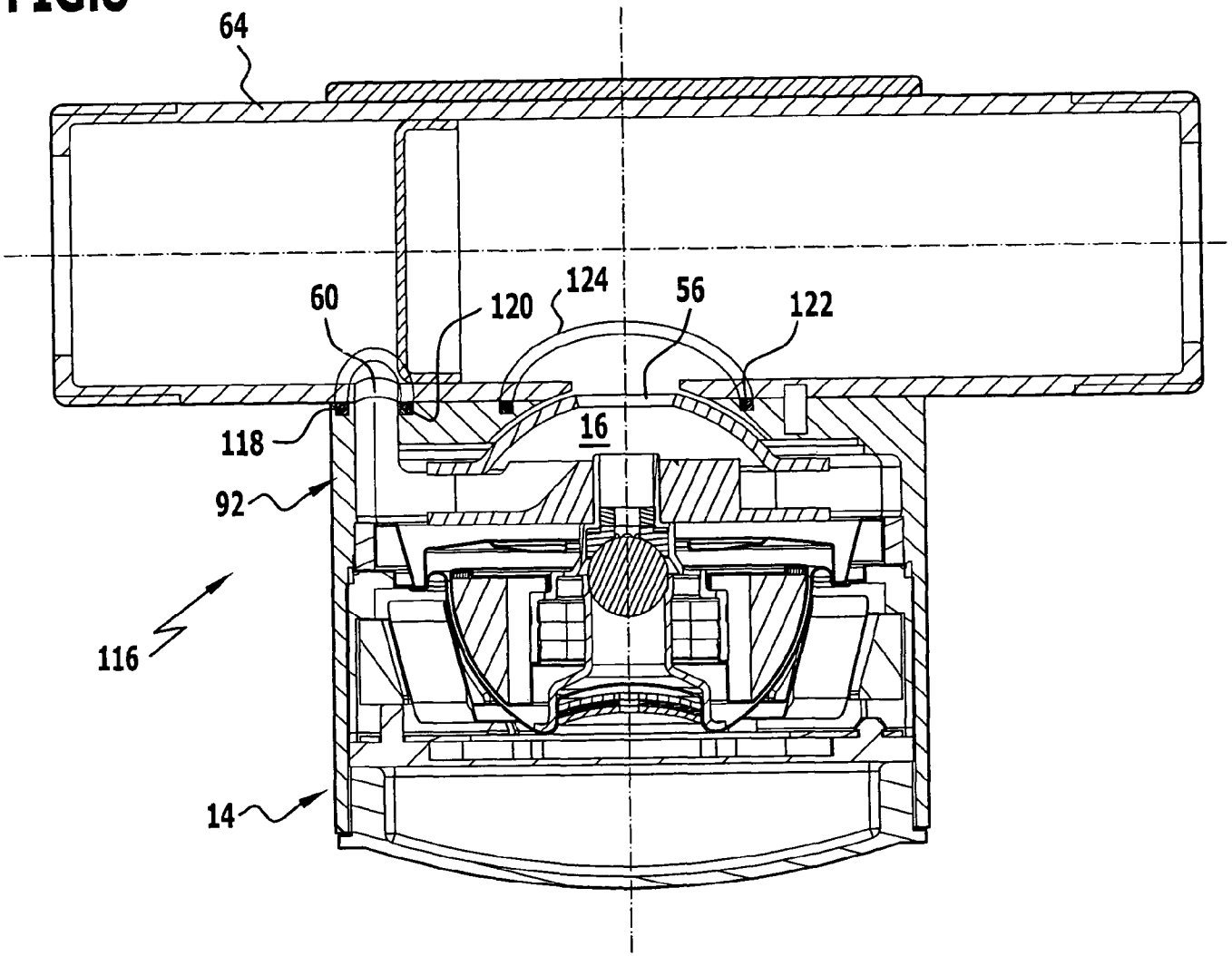
FIG. 8 shows a sectional view of the circulating pump according to FIG. 7 along the line 8-8.

In a fourth embodiment, which is shown in FIGS. 7 and 8 and designated 116 there, a connector element is provided which is basically configured the same as the connector element 64. The same reference numerals are therefore used.

The housing is also substantially configured the same, so the same reference numerals are used.

A groove-shaped recess 118, in which a first seal 120, for example in the form of an O-ring, is seated, is formed in the housing around the second opening 60 of the pumping space 16. This first seal 120 ensures a seal with respect to the connection element 64.

In the same manner, a groove-shaped recess 122, in which a second seal 124 is seated to seal the suction side relative to the connector element 64, is formed in the housing about the first opening 56.

Otherwise, the circulating pump 116 functions as described above.

Figure 9:
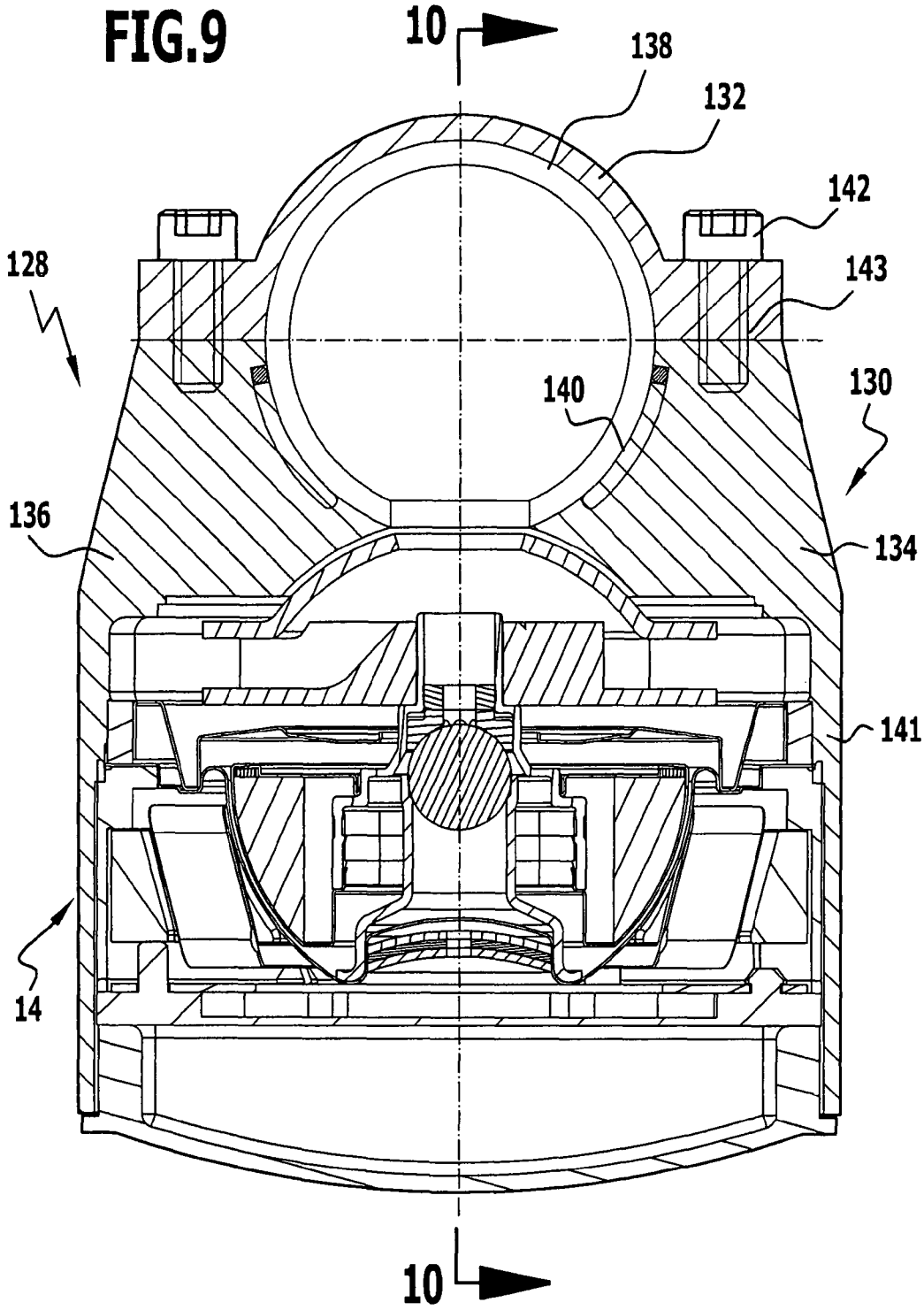
FIG. 9 shows a sectional view of a fifth embodiment of a circulating pump according to the invention.
Figure 10:
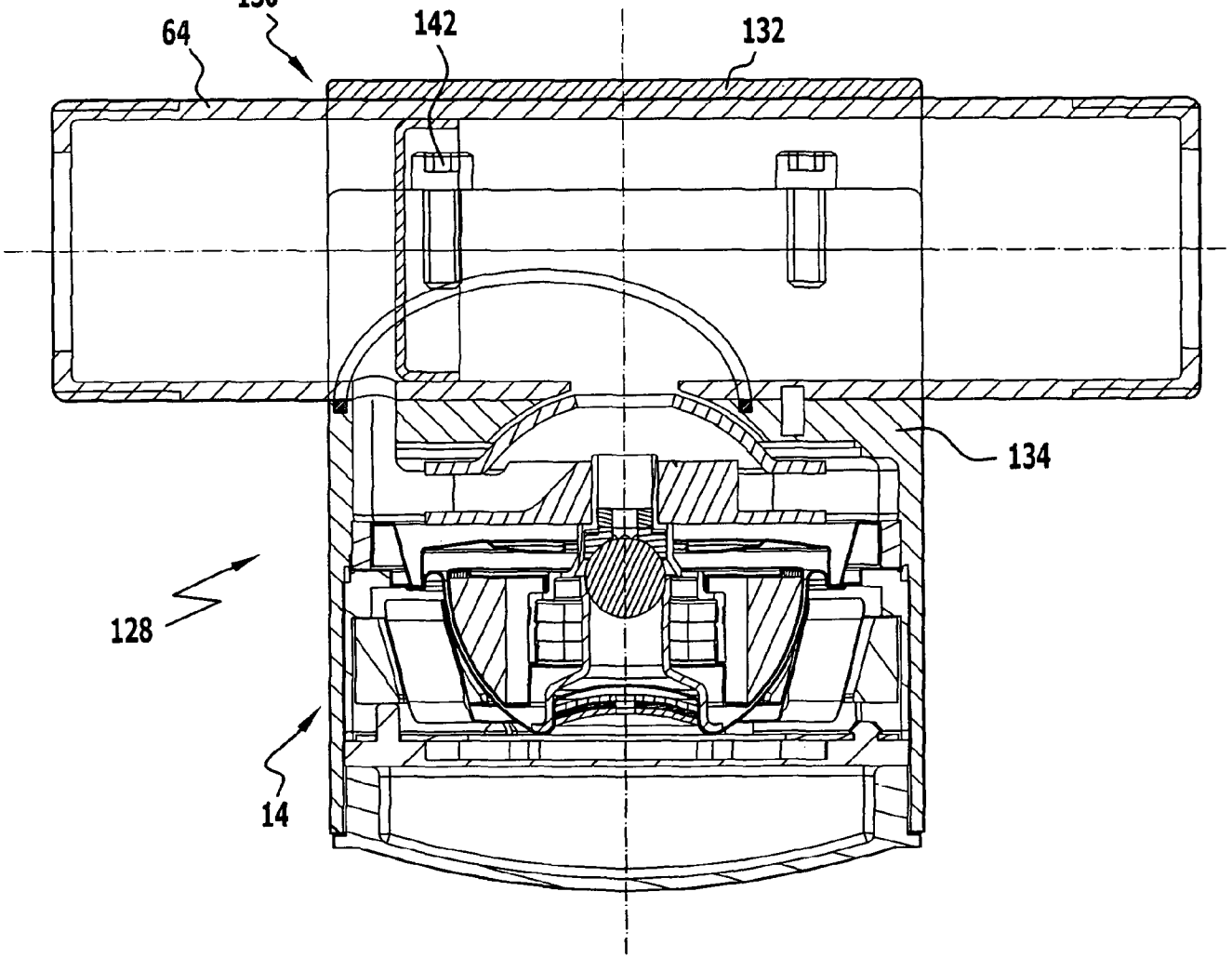
FIG. 10 shows a sectional view of the circulating pump according to FIG. 9 along the line 10-10.

In a fifth embodiment, which is shown in FIGS. 9 and 10 and designated 128 there, a housing 130 is provided, which has a first housing part 132 and a second housing part 134. A pump part, which is basically configured the same as the pump part 14 of the circulating pump 10, is formed on the second housing part 134. The same reference numerals are therefore used as for the circulating pump 10.

A fixing region 136 is seated in one piece on the pump part 14 above the pumping space. The fixing region 136 is comprised by the second housing part 134.

A connector element, which is basically configured the same as the connector element of the circulating pump 10 (the same reference numerals are therefore used) is seated between the first housing part 132 and a second housing part 134. In particular, it is held clamped between the first housing part 132 and the second housing part 134.

For this purpose, the first housing part 132 has a (half) receiver 138 which is adapted to the connector element 64 and is supplemented by a (half) receiver 114 on the fixing region 136 to form a receiver for the connector element 64.

The first housing part 132 is connected to the second housing part 134 by means of a plurality of screws or bolts 142. The screws or bolts 142 press the first housing part 132 against the second housing part 134 and thus hold the connector element 64 on the housing 130.

The screws or bolts 142 have projected into the fixing region 136 and thus have projected into solid material. They are located completely above the pumping space. In particular, receiving regions 143 for the screws or bolts 142 are arranged offset toward the axis of the pumping space with respect to a side wall 141 of the housing part 134.

Otherwise, the circulating pump 128 functions as described above.

Figure 11:
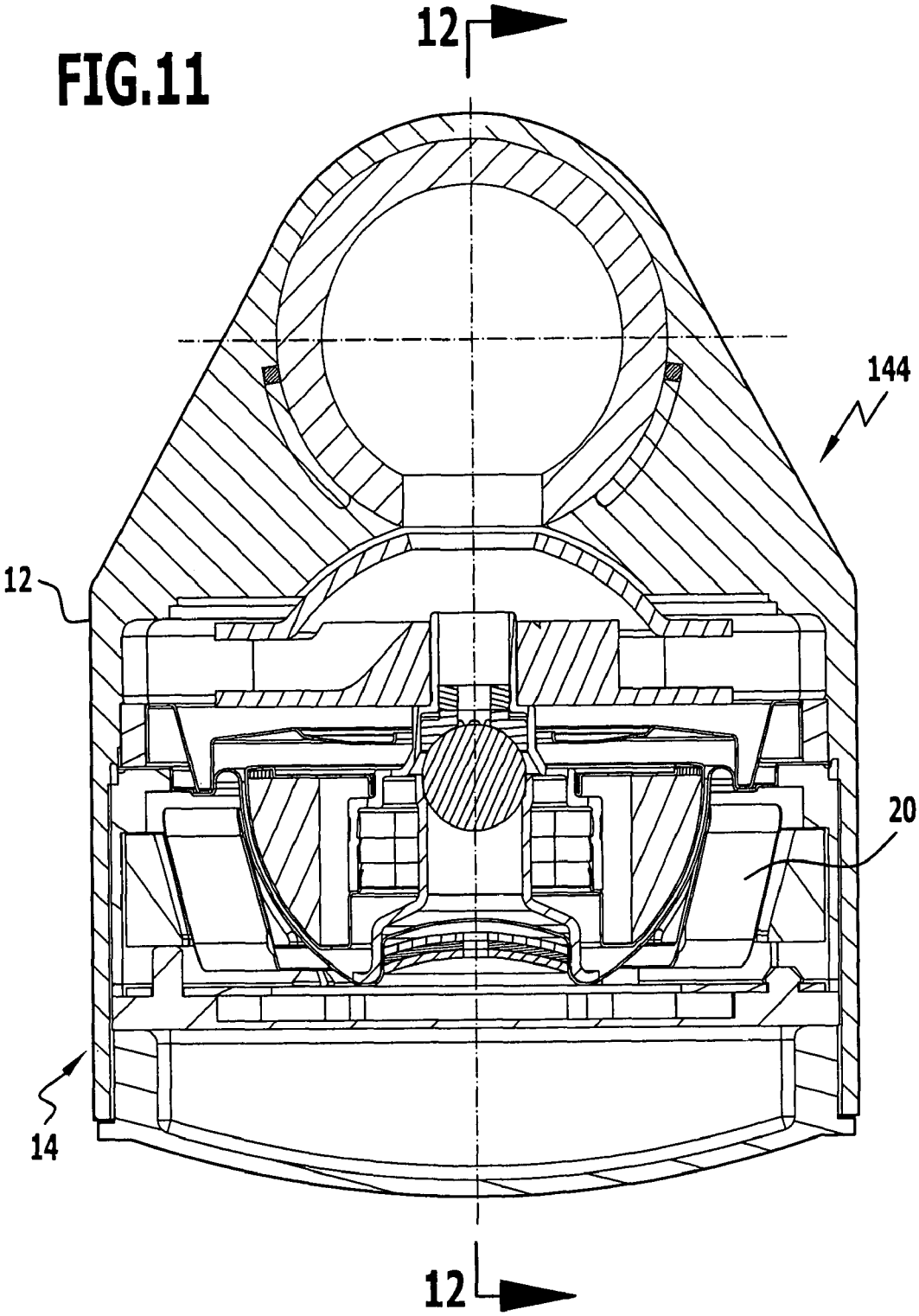
FIG. 11 shows a sectional view of a sixth embodiment of a circulating pump according to the invention.
Figure 12:
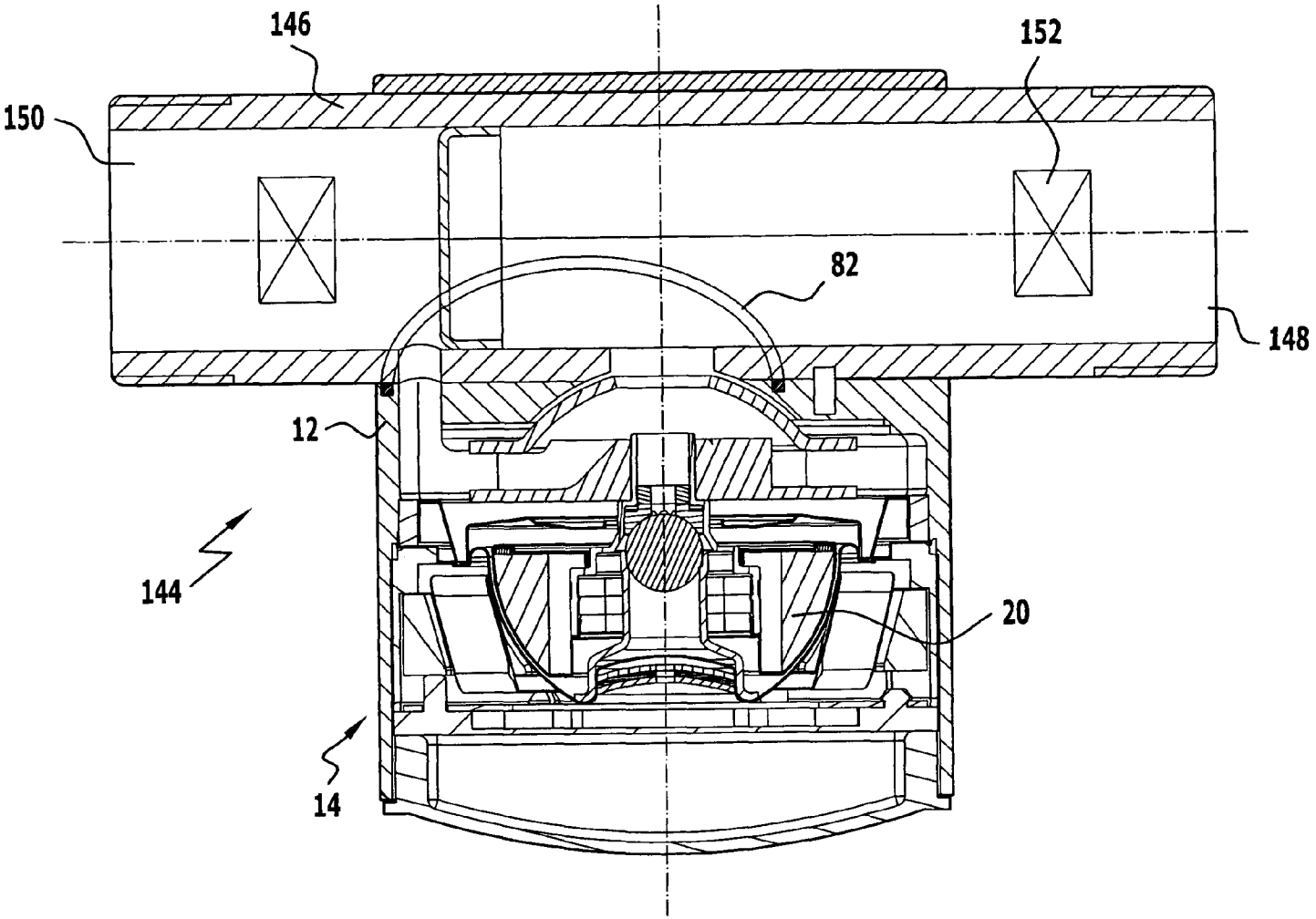
FIG. 12 shows a sectional view of the circulating pump according to FIG. 11 along the line 12-12.

In a sixth embodiment, which is shown in FIGS. 11 and 12 and designated 144 there, a housing is provided, which is basically configured the same as the housing 12 of the circulating pump 10. The same reference numerals are therefore used. A cast iron pipe or brass pipe is provided as the connector element 146, on which a suction connector 148 and a pressure connector 150 are formed.

The connector element 146 may have one or more engagement faces 152, for example, for a pipe wrench.

The arrangement of the seal 82 is as in the circulating pump 10, in other words, an O-ring is seated in a recess on the housing.

Otherwise, the circulating pump 144 functions as described above.

Figure 13:
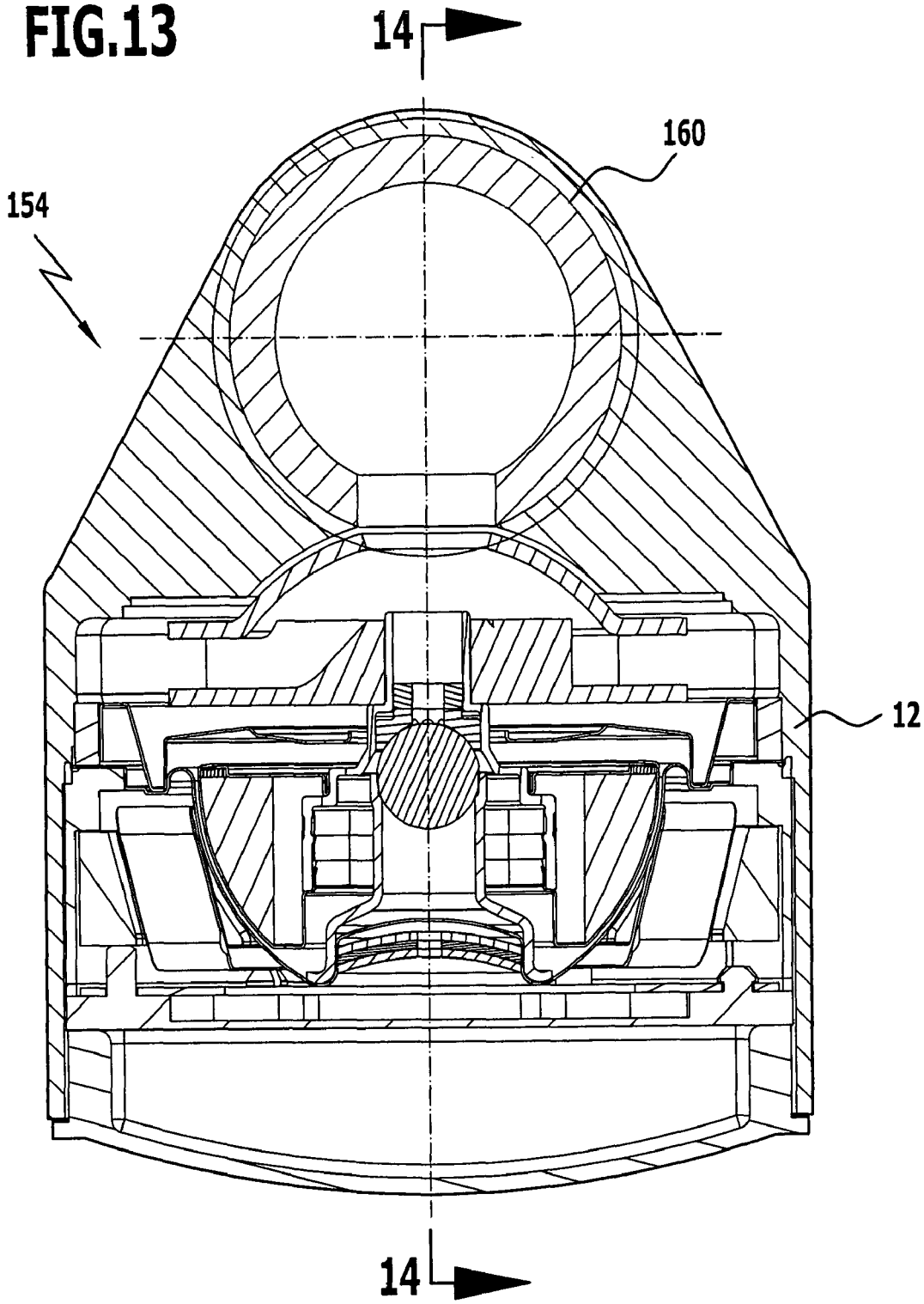
FIG. 13 shows a sectional view of a seventh embodiment of a circulating pump according to the invention.
Figure 14:
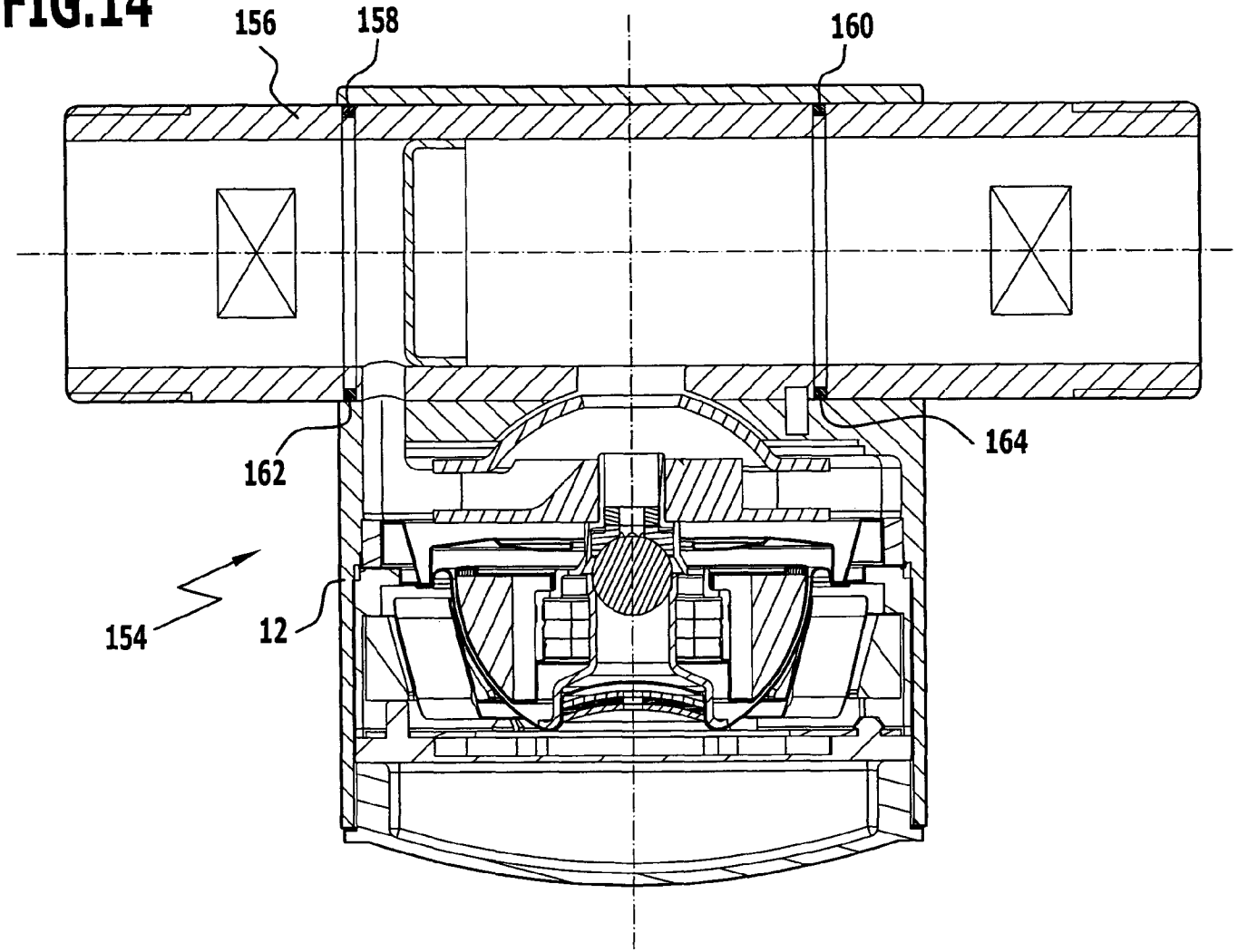
FIG. 14 shows a sectional view of the circulating pump according to FIG. 13 along the line 14-14.

A seventh embodiment, which is shown in FIGS. 13 and 14 and is designated 154 there, is basically configured the same as the sixth embodiment 144. A cast iron pipe or brass pipe is in turn provided as the connector element 156. This has, on its outer side, peripheral spaced apart groove-shaped recesses 158, 160, into which respective seals 162, 164 are inserted. The circulating pump 144 thus corresponds substantially to the circulating pump 144. In the case of the circulating pump 104, the connector element 106 is formed by a thin-walled pipe, for example made of high-grade steel. As the connector element 156 is made of cast iron or brass, and is correspondingly thick-walled, the recesses 158, 160 can be produced therein without bulging into the inner space of the connector element 156.

Otherwise, the circulating pump 154 functions as described above.

Figure 15:
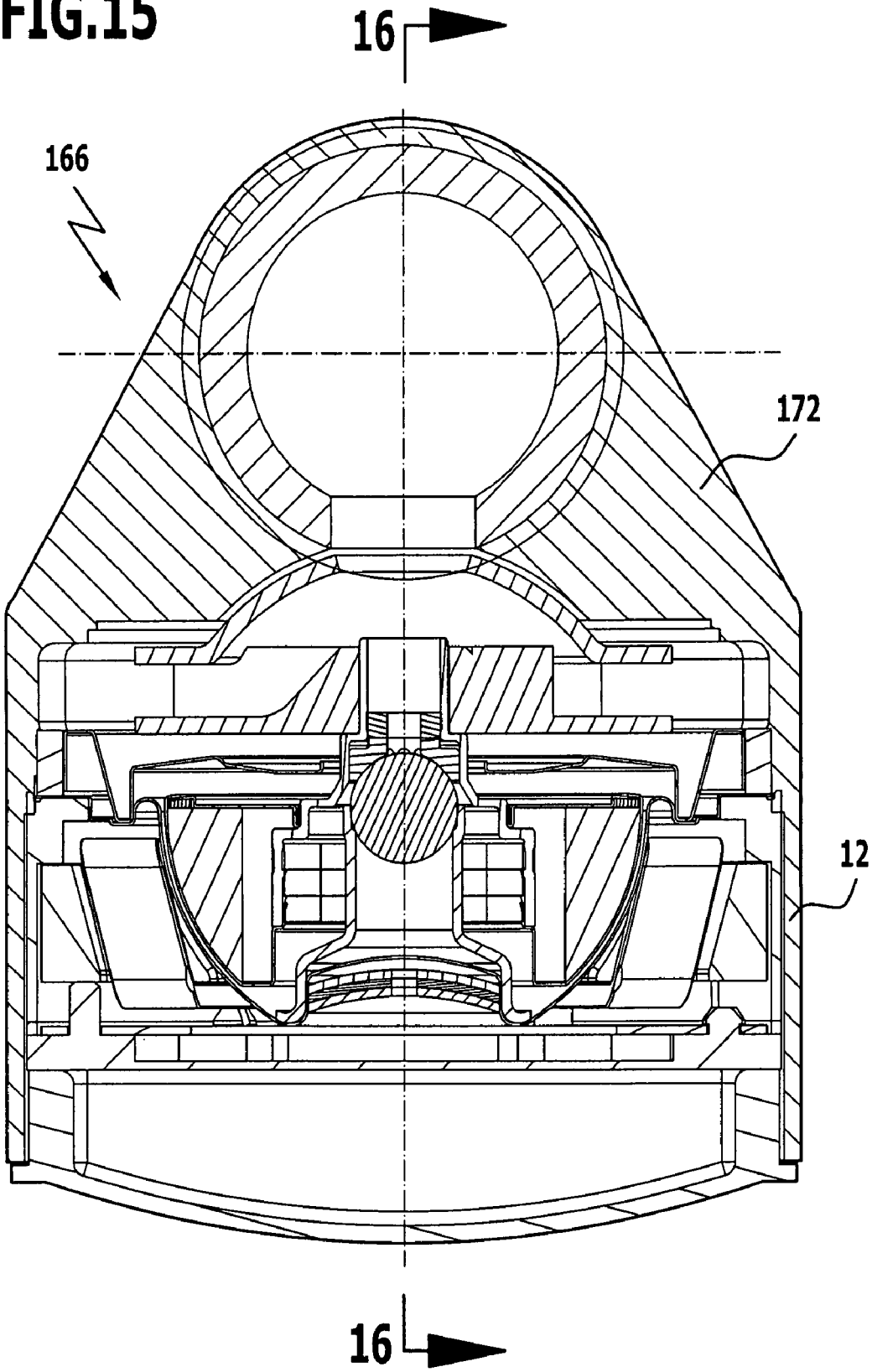
FIG. 15 shows a sectional view of an eighth embodiment of a circulating pump according to the invention.
Figure 16:
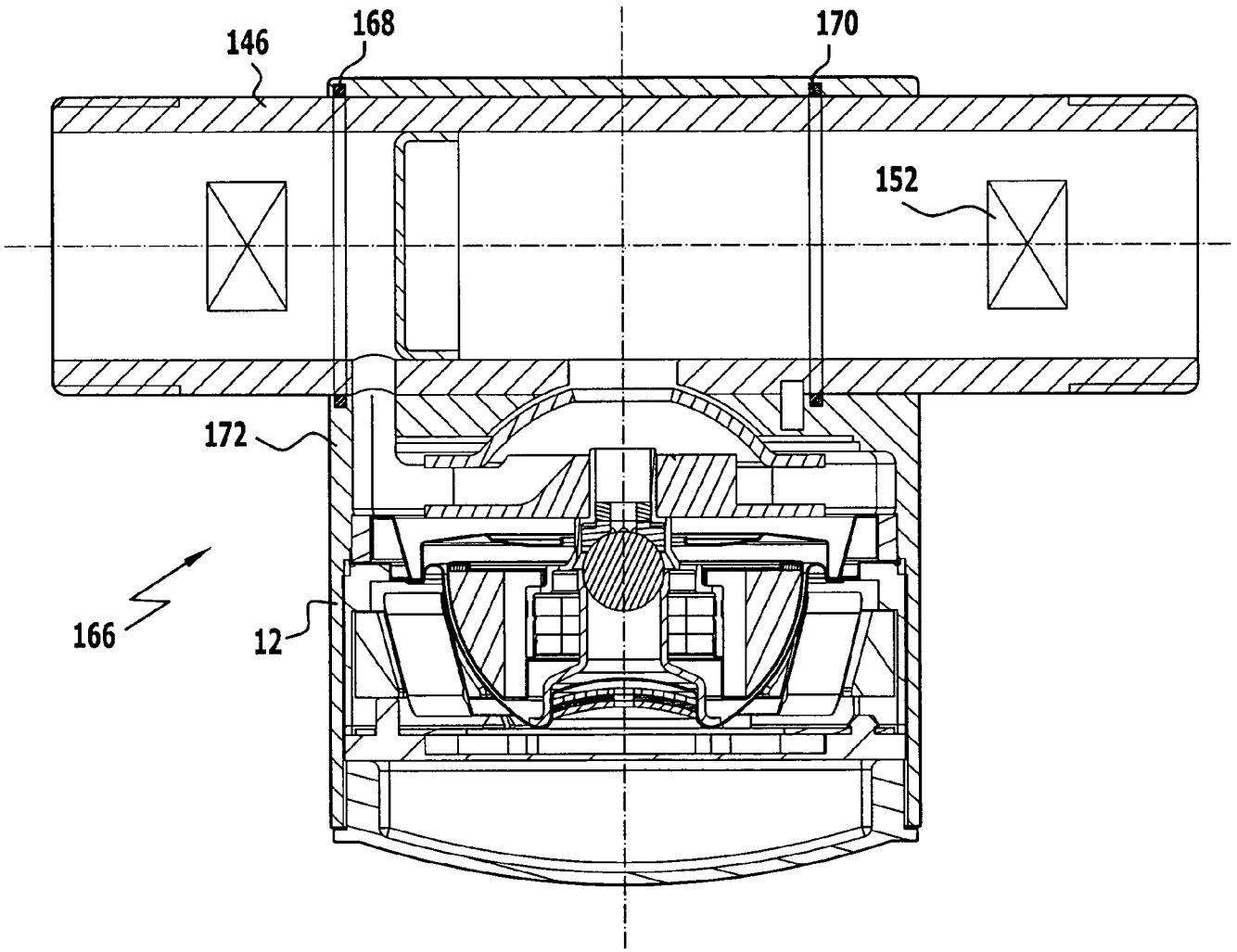
FIG. 16 shows a sectional view of the circulating pump according to FIG. 15 along the line 16-16.

In an eighth embodiment, which is shown in FIGS. 15 and 16 and designated 166 there, recesses 168 and 170 are produced in an alternative embodiment in a corresponding housing 172. This embodiment corresponds to the circulating pump 90 according to FIGS. 3 and 4, the connector element 164 being thick-walled in the circulating pump 166 and, in particular being made of cast iron or brass.

Figure 17:
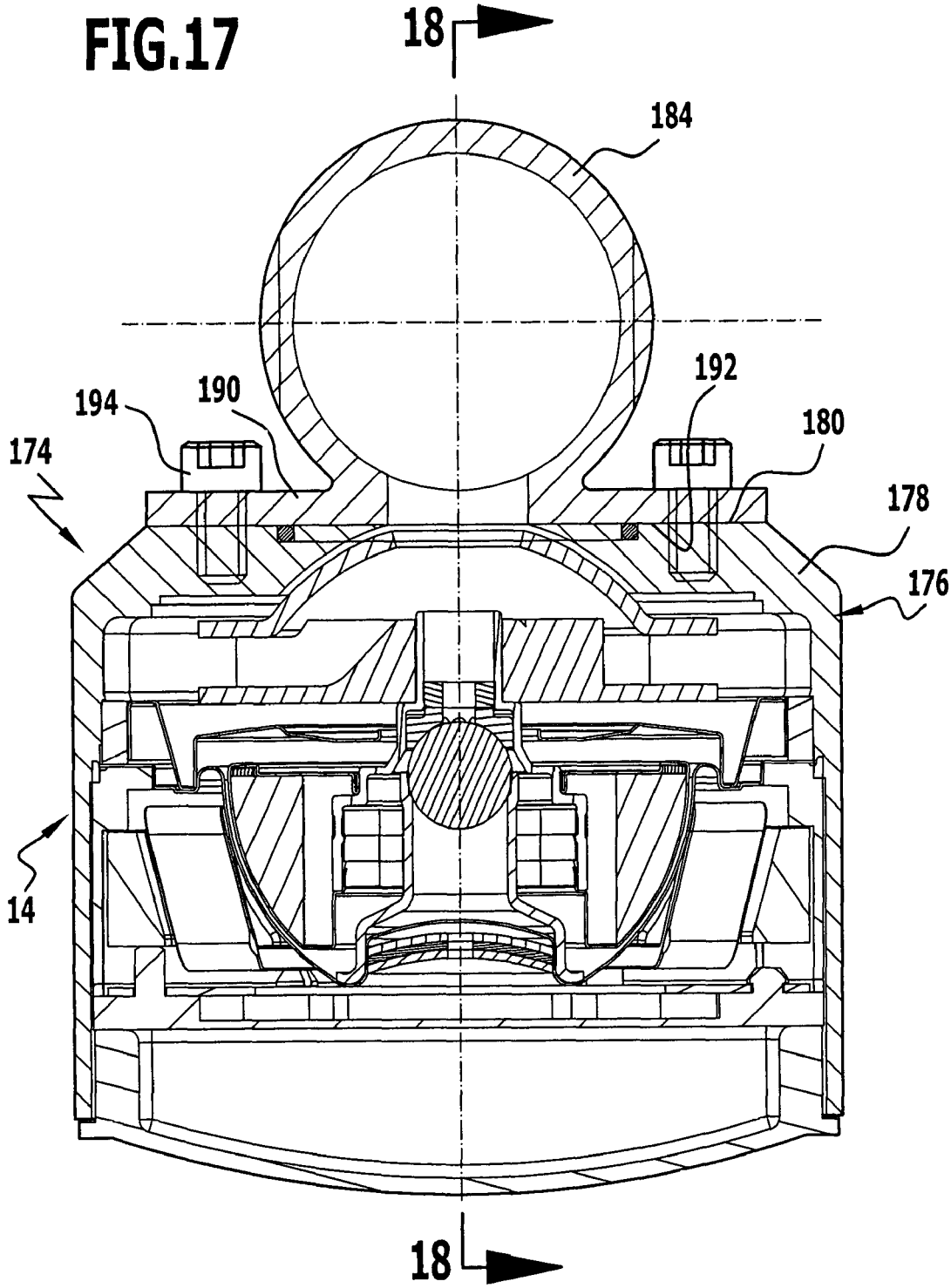
FIG. 17 shows a sectional view of a ninth embodiment of a circulating pump according to the invention.
Figure 18:
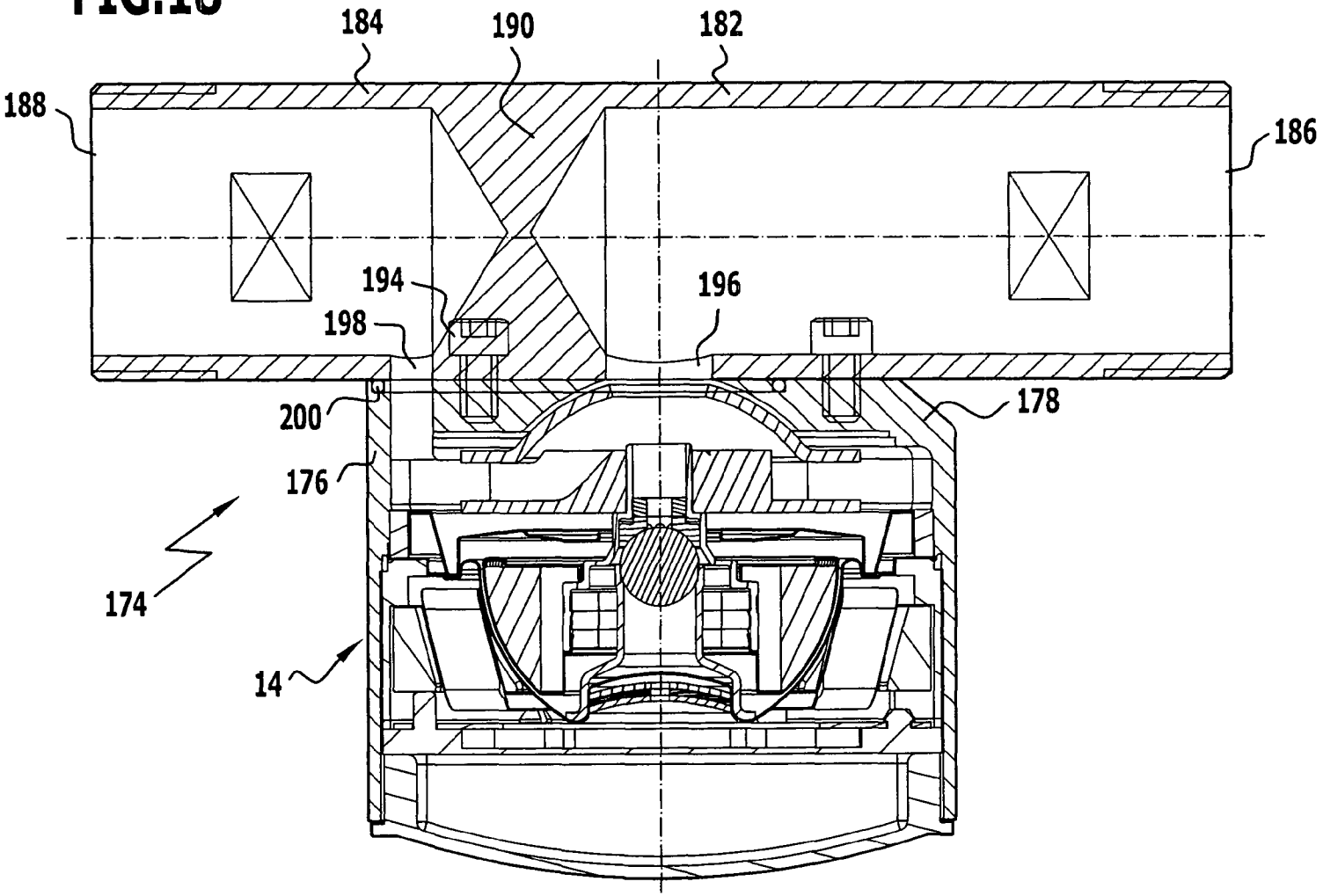
FIG. 18 shows a sectional view of the circulating pump according to FIG. 17 along the line 18-18.

In a ninth embodiment, which is shown in FIGS. 17 and 18 and designated 174 there, a housing 176 is provided with a fixing region 178 and a pump part. The pump part is basically configured the same as described with the aid of the first embodiment 10. The same reference numerals are therefore used in this regard.

The fixing region 178 is formed (completely) above the pump part 14 (with respect to the rotational axis 24). It has a substantially level outer side 180.

A connector element 182 is provided, which comprises a pipe 184, on which a suction connector 186 and a pressure connector 188 are formed. The pipe 184 is produced, for example, from cast iron or brass.

The suction connector 186 and the pressure connector 188 are separated in the pipe 184 by means of a wall 190.

A flange 190 is arranged on the pipe 134, for example along an axis of extent of the pipe, by means of which flange the connector element 182 can be fixed to the fixing region 178. The flange 190 provides a substantially level contact face 192.

The connector element 182 is connected by means of the flange 190 to the fixing region 178 of the housing 176 by means of a plurality of screws or bolts 194, the screws or bolts 194 being fixed to the fixing region 178 of the housing 176. They are located completely above the pumping space and do not project, in particular, into side walls, between which the pumping space is formed.

The screws or bolts 194 are arranged radially inwardly offset with respect to the side walls and project into solid material of the fixing region 178.

A first opening 196, which is in fluid connection with the suction connector 186, is formed in the connector element 182. Furthermore, a second opening 198 is formed, which is in fluid connection with the pressure connector 188.

A seal 200, which is configured, for example, in the form of an O-ring, surrounds the two openings 196, 198 on the housing 176, in other words these two openings 196 and 198 are located inside the sealing ring. The seal 200 is seated in a groove-shaped recess, which is formed on the housing 176.

The pumping space 16 is sealed relative to the connector element 182 by the seal 200.

Otherwise, the circulating pump 174 functions as described above.

Figure 19:
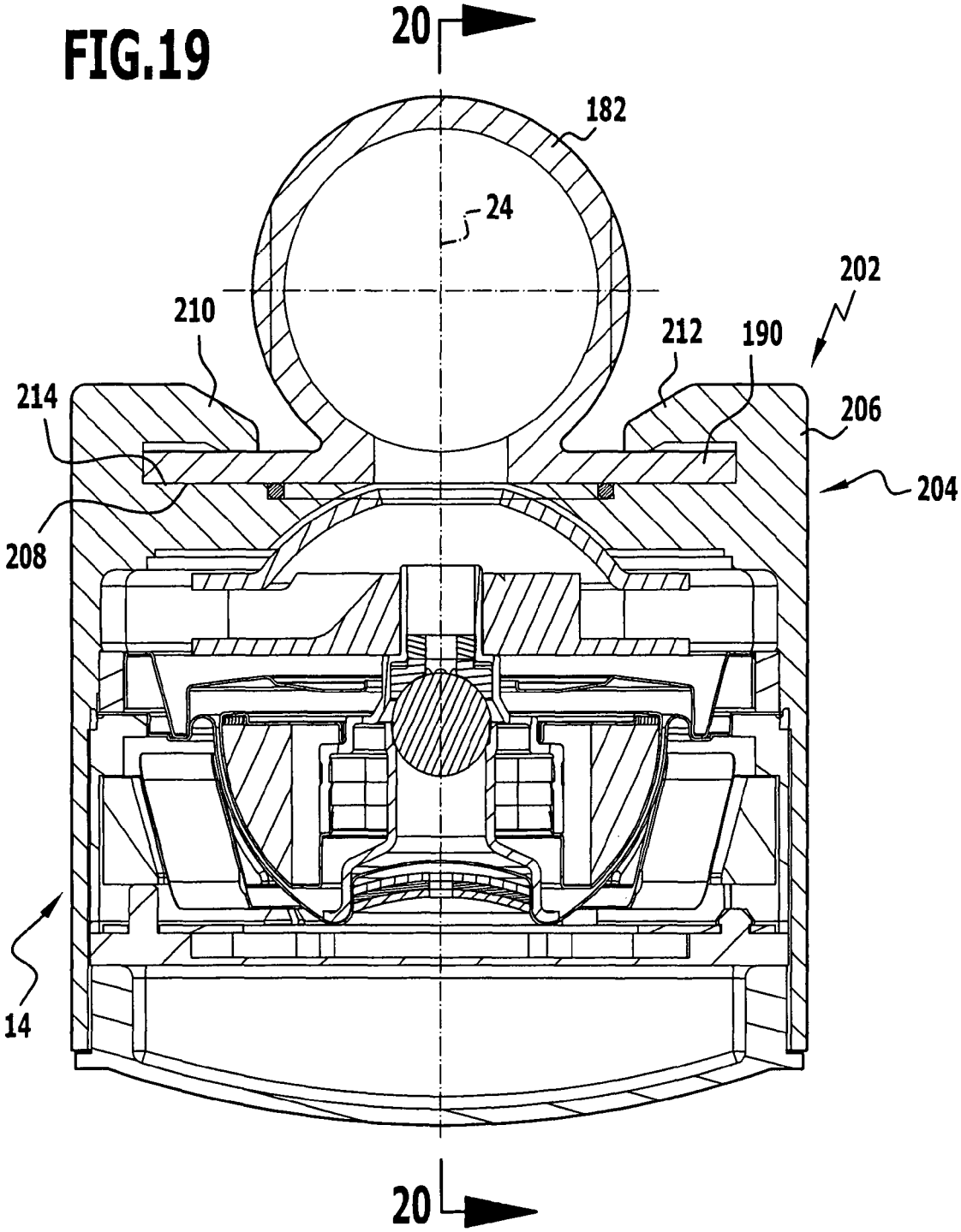
FIG. 19 shows a sectional view of a tenth embodiment of a circulating pump according to the invention.
Figure 20:
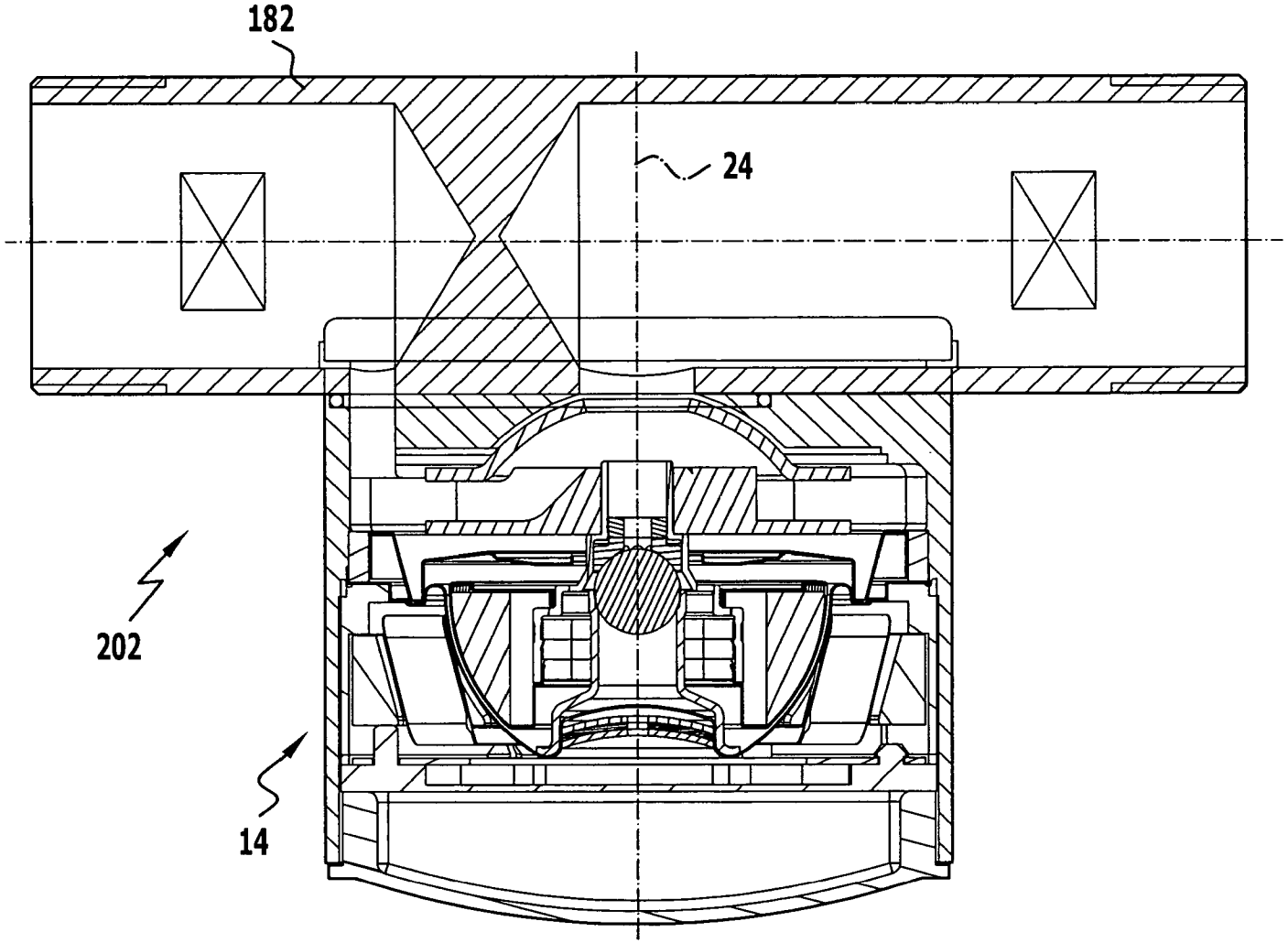
FIG. 20 shows a sectional view of the circulating pump according to FIG. 19 along the line 20-20.

In a tenth embodiment, which is shown in FIGS. 19 and 20 and is designated 202 there, a connector element is provided, which is basically formed like the connector element 182 in the circulating pump 174. The same reference numerals are therefore used. The connector element 182 with its flange 190 is held on a housing 204. This housing 204 has a fixing region 206 for the connector element 182, which is arranged above the pumping space. Furthermore, the housing 204 has a pump part, which is basically configured the same as the pump part 14. The same reference numerals are therefore used.

The fixing region 206 comprises a part region with a substantially level contact face 208. The flange 190 can be placed on the housing 204 by means of this contact face 208.

Furthermore, the fixing region 206 comprises opposing clamping webs 210, 212, which extend parallel to the connector element 182. These clamping webs 210, 212 grip over the flange 190 of the connector element 182. The clamping webs 210, 212 are configured elastically, in this case, in such a way that they exert a clamping force on the flange 190 in order to hold the connector element 182 so as to be clamped on the fixing region 206.

They are, furthermore, configured in such a way that the connector element 182 can be inserted intro a holding chamber transversely to the rotational axis 24 parallel to its direction of extent to produce the connection with the housing 204. The holding chamber 214 is, in this case, formed between the clamping webs 210, 212 and the contact face 208.

One or more web connections can be provided as described with the aid of the circulating pump 10 for fixing in relation to its extension direction.

Figure 21:
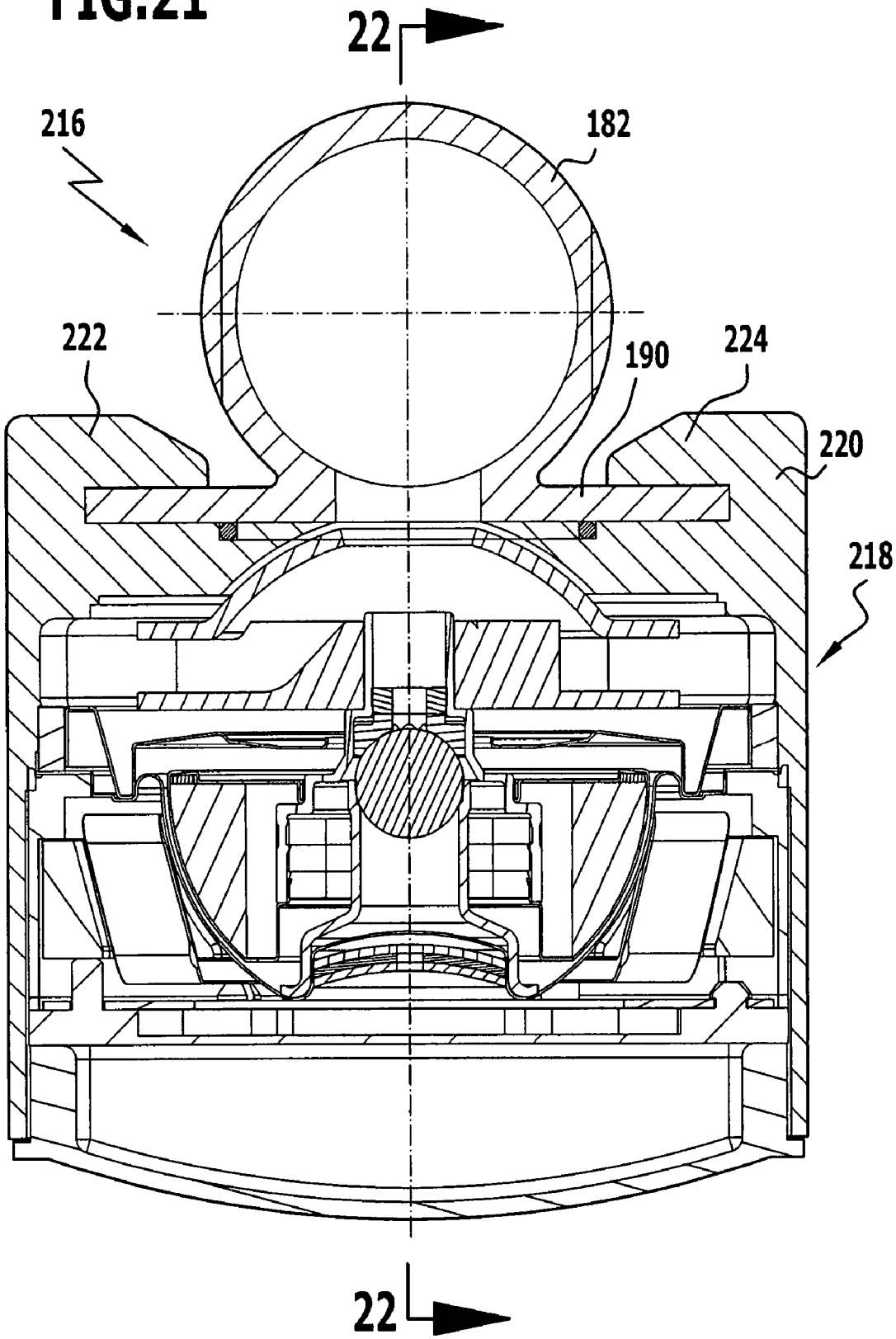
FIG. 21 shows a sectional view of an eleventh embodiment of a circulating pump according to the invention.
Figure 22:
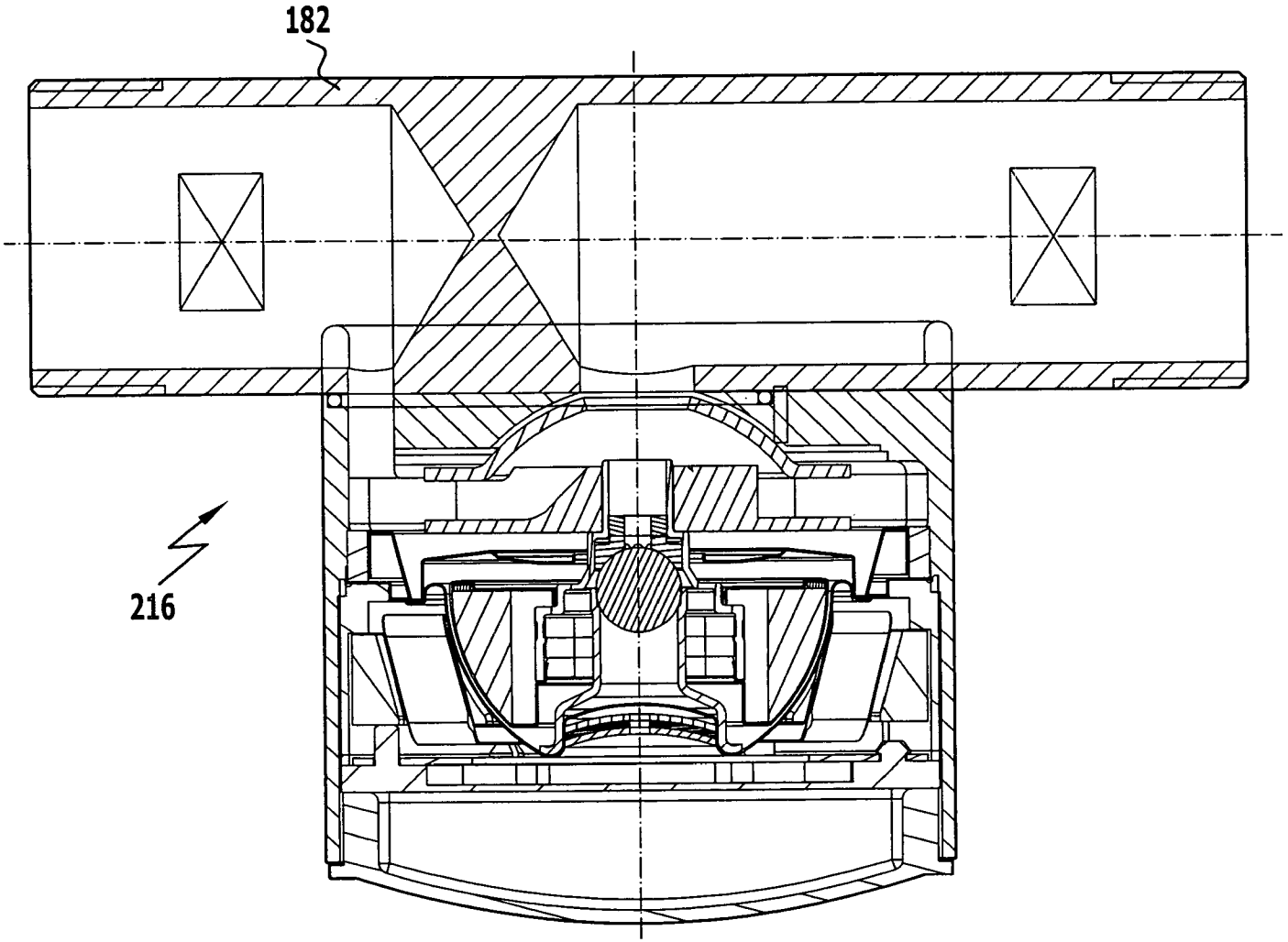
FIG. 22 shows a sectional view of the circulating pump according to FIG. 21 along the line 22-22.

In an eleventh embodiment, which is shown FIGS. 21 and 22 and designated 216 there, a connector element, which corresponds to the connector element 182, is in turn provided.

A housing 218 comprises a fixing region 220, the connector element 182 being held by its flange 190 on this fixing region 220. The flange 190 is embedded, in this case, at least partially into the fixing region 220.

When producing the housing 218, for example by an injection moulding method, the connector element 182 is held in the injection moulding mould. The flange 190 is moulded around, in this case; web elements 222, 224 are thus formed, which rest on the flange 190. A contact side opposing the web elements 222, 224 is filled with material for the housing 218 so an embedded hold of the connector element 182 is achieved.

Figure 23:
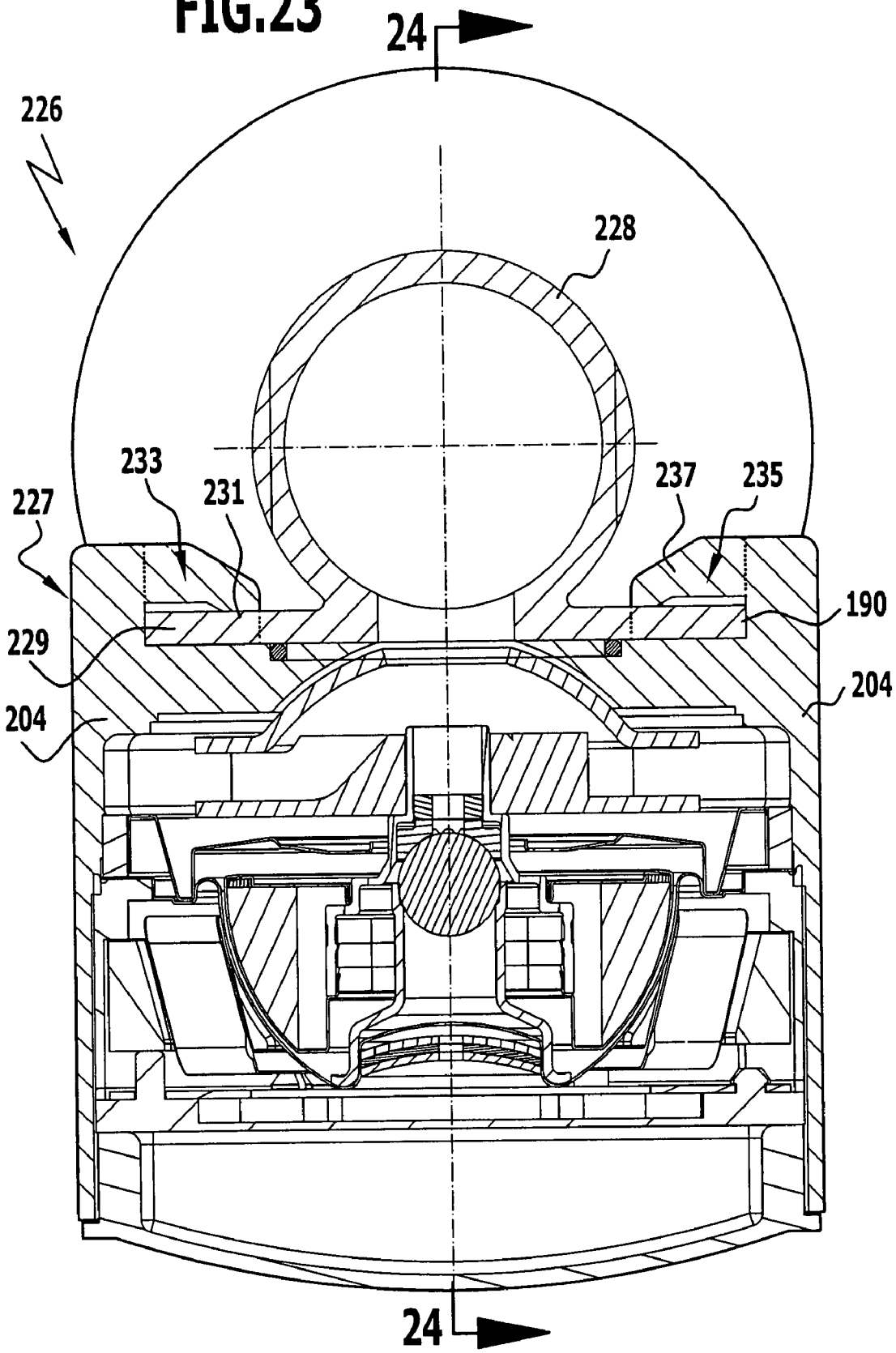
FIG. 23 shows a sectional view of a twelfth embodiment of a circulating pump according to the invention.
Figure 24:
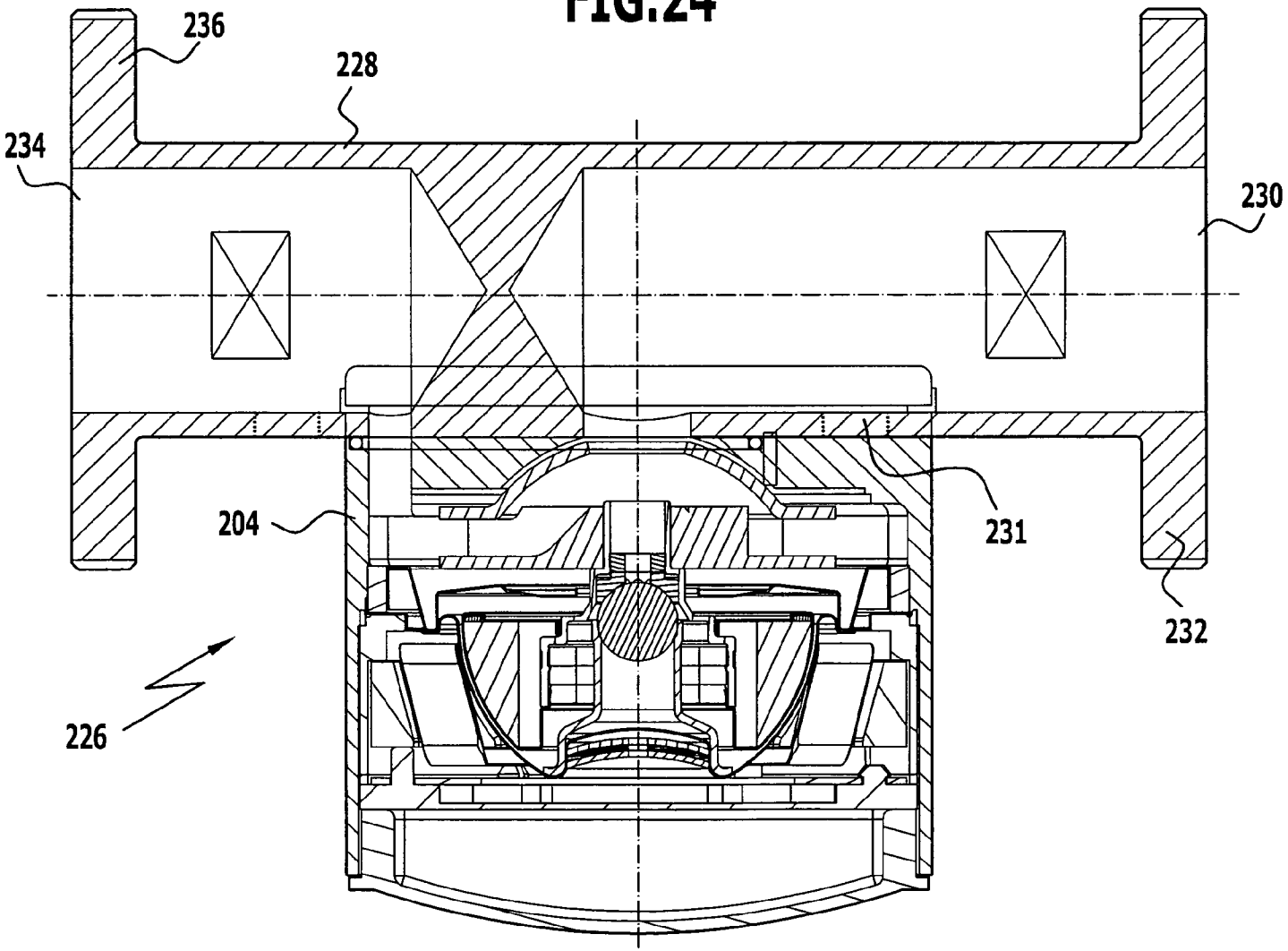
FIG. 24 shows a sectional view of the circulating pump according to FIG. 23 along the line 24-24.

In a twelfth embodiment, which is shown in FIGS. 23 and 24 and designated 226 there, a connector element 228 is provided, which is provided on its suction connector 230 with a peripheral annular flange 232. An annular flange 236 is also provided on the opposing pressure connector 234. The flanges 232 and 236 may be provided with threads.

The connector element 228 has a plate-shaped bracket-like flange 229 formed thereon in one piece. This flange 229 corresponds to the flange 190 and is used for holding on the associated fixing region 227.

The flange 229 is provided, in this case, with one or more interruptions 231 to allow sliding on of the connector element 228. (The maximum displacement path is limited because of the annular flanges 232 and 236.)

The fixing region 227 comprises opposing clamping webs 233, 235, which are basically formed the same as the clamping webs 210, 212; however, they are also provided with interruptions 237, matched to the flange 229, to allow sliding on of the connector element 228.

During the production of the connector element/housing connection, the interruptions 237 of the clamping webs 233, 235 of the fixing region 227 and of the flanges 229, are orientated in such a way that the connector element 228 can be placed on the substantially level contact region of the fixing region 227 below the clamping webs 233, 235. The interruptions 237 allow a guiding through of the flange 229 (at non-interruption regions of the flange 229) and the interruptions 231 on the flange 229 allow a guiding through of the flange 229 at non-interruption regions of the clamping webs 233, 235.

The connector element 228 is then displaced to bring about an engagement between the clamping webs 233, 235 and the flange 229 and therefore to fix the connector element 228 to the housing.

Otherwise, the circulating pump 226 is configured like the circulating pump 202. The same reference numerals as in FIGS. 19 and 20 are therefore used.

Figure 25:
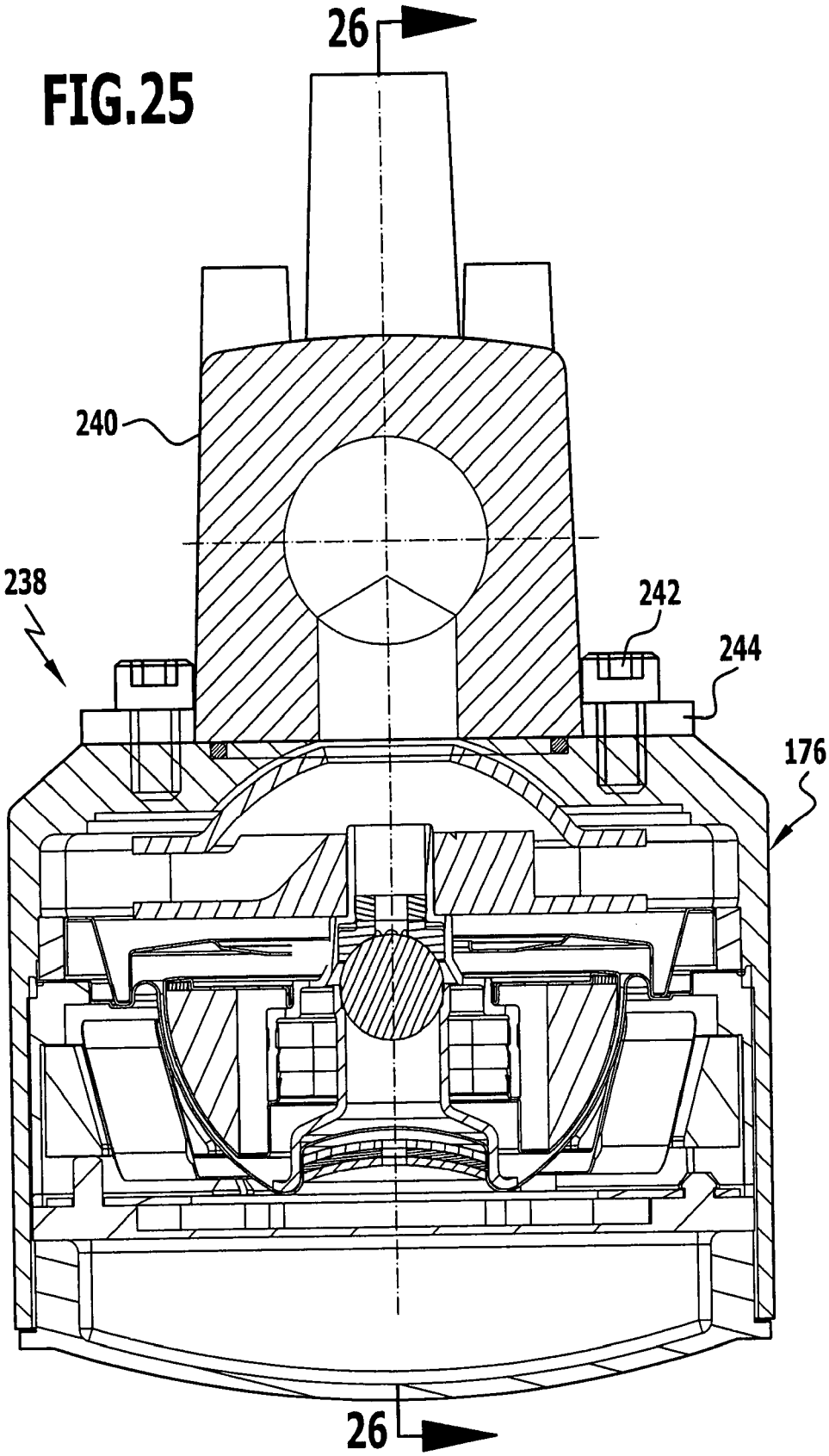
FIG. 25 shows a sectional view of a thirteenth embodiment of a circulating pump according to the invention.
Figure 26:
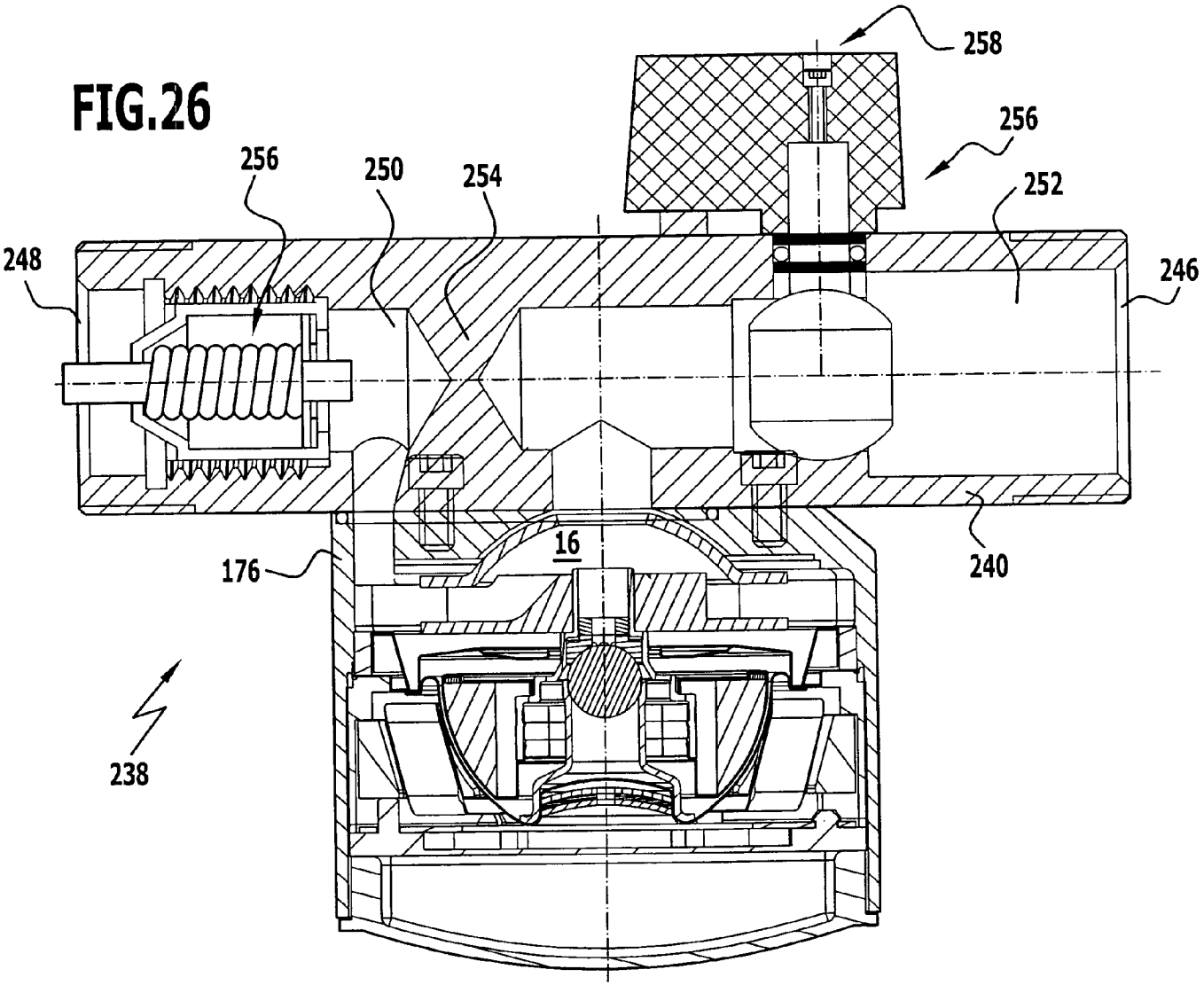
FIG. 26 shows a sectional view of the circulating pump according to FIG. 25 along the line 26-26.

In a thirteenth embodiment, which is shown in FIGS. 25 and 26 and designated 238 there, a housing is provided, which is basically configured the same as the housing 176 in the circulating pump 174. The same reference numerals are therefore used.

A connector element 240 is fixed to the housing 176 by means of a plurality of screws 242. The connector element 240, for this purpose, has a corresponding flange 244.

The connector element 240 has a suction connector 246 and an opposing pressure connector 248. The pressure connector 248 is formed on a pressure connector region 250. The suction connector 246 is formed on a suction connector region 252.

Arranged between the pressure connector region 250 and the suction connector region 252 in the inner space of the connector element 240 is a wall 254, which separates these two regions 250 and 252 from one another.

A check valve 256, which prevents a liquid flow into the pumping space 16 by means of the pressure connector region 250, is seated on the pressure connector region 252.

A blocking device 256, which, for example, comprises a ball cock 258, is seated on the suction connector region.

The circulating pump 238 can be used as a processing water pump.

Otherwise, the circulating pump 238 functions as described above.

Figure 27:
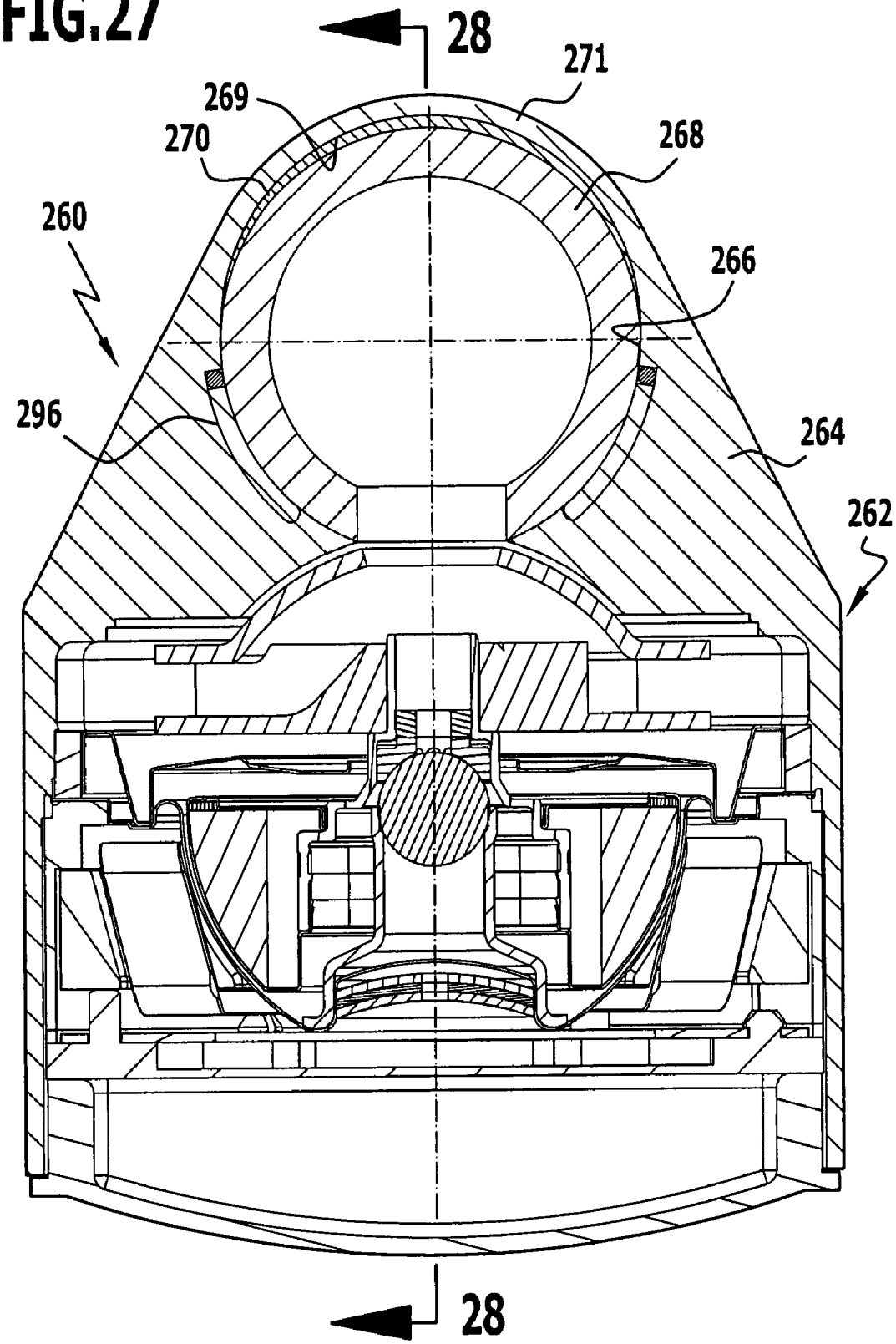
FIG. 27 shows a sectional view of a fourteenth embodiment of a circulating pump according to the invention.
Figure 28:
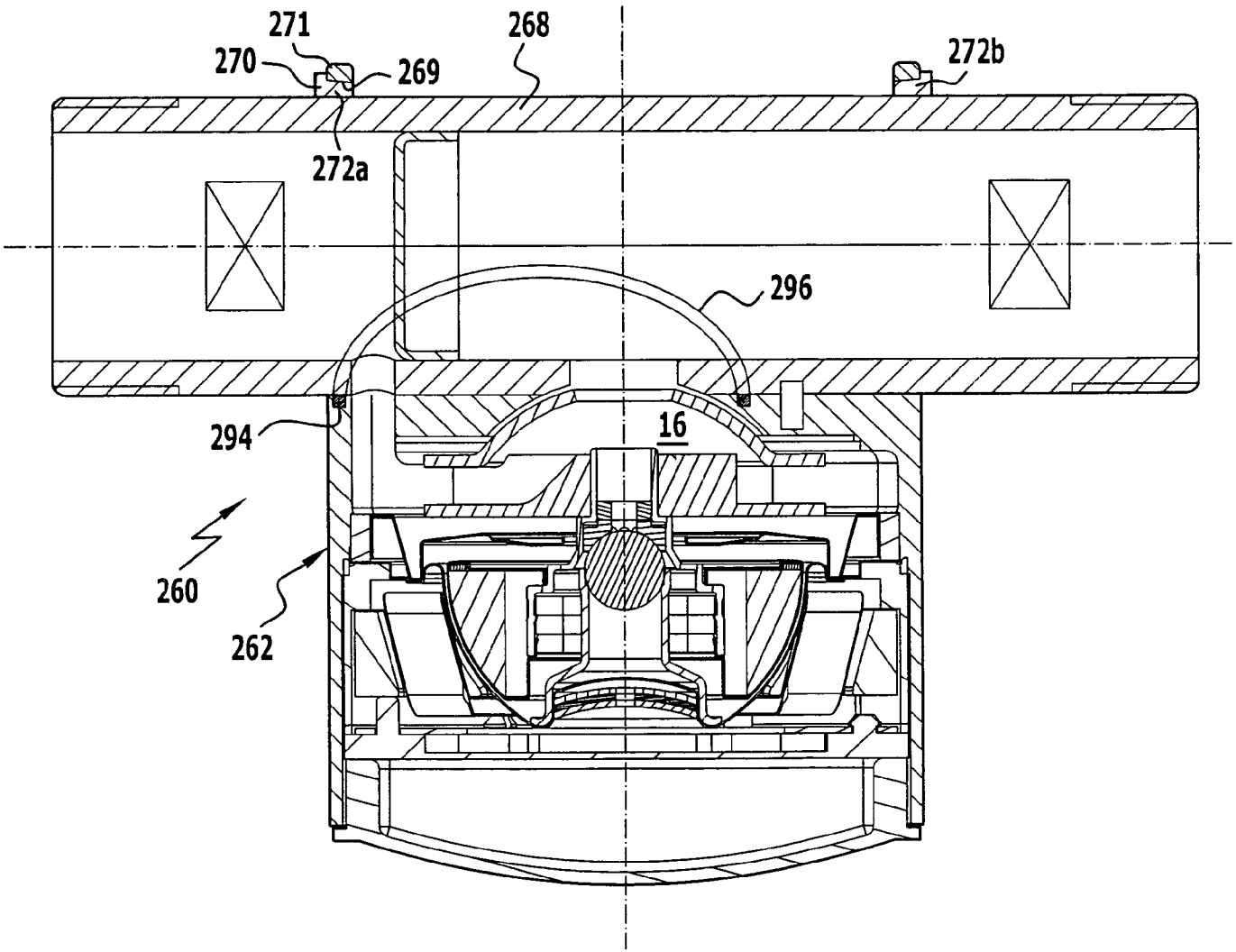
FIG. 28 shows a sectional view of the circulating pump according to FIG. 27 along the line 28-28.

In a fourteenth embodiment, which is shown in FIGS. 27 and 28 and is designated 260 there, a housing 262 is provided, which comprises a fixing region 264 and a pump part. The pump part is, in this case, configured basically the same as described with the aid of the circulating pump 10. The same reference numerals are therefore used.

The fixing region 264 has a receiver 266 for a connector element 268. The receiver 266 has a larger cross-sectional area than the connector element 268, so an intermediate space 269 is formed between the connector element 268 and the fixing region 264. The intermediate space 269 extends, for example, over a semi-circle and is crescent-shaped. The intermediate space 269 allows insertion of the connector element 268 into the receiver 266.

To form the intermediate space 269, the fixing region comprises bowed regions 271 which are spaced apart and toward the top and the outside surround the connector element 268 (with the intermediate space 269).

The bowed regions 271 are configured, in particular, on or in the vicinity of respective lateral housing ends (FIG. 28) in order to fix the connector element 268 there.

One or more, in particular crescent-shaped wedge elements 270 are arranged in the intermediate region between the fixing region 264 and the connector element 268. The connector element 268 is clamped to the housing 262 by means of the bowed regions 271 of the fixing region 264 by one or more such wedge elements 270.

For example, opposing wedge elements 272*a*, 272*b* are provided in order to ensure spaced-apart jamming or bracing of the connector element 268 in the receiver 266.

A groove-shaped recess 294 is formed in the housing and surrounds a first opening for fluid connection of the pumping space 16 to the suction connector and surrounds a second opening for fluid connection of the pumping space 16 to a pressure connector. A seal 296 is inserted into this recess 264. This seal arrangement corresponds to that of the circulating pump 10, the circulating pump 128 and the circulating pump 144.

Otherwise, the circulating pump 260 functions as described above.

The invention claimed is:

1. A Circulating pump, comprising:

a housing with a pump part, in which a pumping space is arranged;

a suction connector, which is in fluid connection with the pumping space via a pump inlet; and a pressure connector, which is in fluid connection with the pumping space via a pump outlet;

wherein:

at least one of the suction connector and the pressure connector are formed on at least one connector element, which is a separate part from the housing;

the at least one connector element is fixed to the housing;

the housing has a fixing region for fixing the at least one connector element, the fixing region is connected in one piece with the pump part, is arranged above the pumping space, is connected in one piece with side walls forming the pumping space, and does not extend into the side walls;

a housing part below the fixing region is free of fixing elements for the fixing region;

the at least one connector element rests on solid material of the fixing region or the solid material of the fixing region rests on the at least one connector element;

the fixing region surrounds the at least one connector element; and one or more recesses are formed in the pump part and one or more seals are respectively arranged in the one or more recesses, said one or more seals being arranged between the at least one connector element and the housing, the pump inlet and the pump outlet being located within a periphery of said one or more seals.

2. The Circulating pump according to claim 1, wherein the at least one connector element is held entirely by means of the fixing region on the housing.

3. The Circulating pump according to claim 1, wherein the at least one connector element is a pipe connection piece.

4. The Circulating pump according to claim 1, wherein a common connector element for the suction connector is provided on the pressure connector.

5. The Circulating pump according to claim 4, wherein a suction connector region and a pressure connector region of the connector element are separated by a wall.

6. The Circulating pump according to claim 1, wherein the at least one connector element has at least one opening for connection to the pumping space.

7. The Circulating pump according to claim 6, wherein the at least one opening is produced by stamping.

8. The Circulating pump according to claim 1, wherein the at least one connector element is produced from a metallic material.

9. The Circulating pump according to claim 1, wherein the at least one connector element extends along an axis, which is located transversely to a rotational axis of a pump impeller.

10. The Circulating pump according to claim 9, wherein the at least one connector element has a greater length along its axis of extent than the housing.

11. The Circulating pump according to claim 9, wherein the at least one connector element projects with the suction connector over the housing.

12. The Circulating pump according to claim 9, wherein the at least one connector element projects with the pressure connector over the housing.

13. The Circulating pump according to claim 1, wherein the housing is produced from a plastics material.

14. The Circulating pump according to claim 1, wherein the housing has a receiving space for an electric motor.

15. The Circulating pump according to claim 1, wherein a pin connection is provided for fixing the at least one connector element on the housing at least with respect to an axis of the connector element.

16. The Circulating pump according to claim 1, wherein the fixing region is multi-part.

17. The Circulating pump according to claim 16, wherein the at least one connector element is held clamped between opposing parts.

18. The Circulating pump according to claim 17, wherein the opposing parts are connected to one another.

19. The Circulating pump according to claim 1, wherein the fixing region is configured in one piece.

20. The Circulating pump according to claim 1, wherein the at least one connector element is held on the fixing region by means of one or more wedge elements.

21. The Circulating pump according to claim 20, wherein the one or more wedge elements are arranged between the fixing region and the at least one connector element.

22. The Circulating pump according to claim 1, wherein the at least one connector element is cylindrical.

23. A Circulating pump, comprising:

a housing with a pump part, in which a pumping space is arranged;

a suction connector, which is in fluid connection with the pumping space; and a pressure connector, which is in fluid connection with the pumping space;

wherein:

at least one of the suction connector and the pressure connector are formed on at least one connector element, which is a separate part from the housing;

the at least one connector element is fixed to the housing;

a pin connection is provided for fixing the at least one connector element on the housing at least with respect to an axis of the at least one connector element, said pin connection comprising a pin and a recess, one of which is arranged on the pump part and the other of which is arranged on the at least one connector element;

the housing has a fixing region for fixing the at least one connector element, the fixing region is arranged above the pumping space, is connected in one piece with side walls forming the pumping space, and does not extend into the side walls;

a housing part below the fixing region is free of fixing elements for the fixing region;

the at least one connector element rests on solid material of the fixing region or the solid material of the fixing region rests on the at least one connector element; and the fixing region surrounds the at least one connector element.

24. The Circulating pump according to claim 23, wherein one or more seals are arranged between the at least one connector element and the housing.

25. The Circulating pump according to claim 24, wherein the housing has one or more recesses for the respective receiving of said one or more seals.

26. The Circulating pump according to claim 24, wherein the at least one connector element has one or more recesses for the respective receiving of said one or more seals.

27. The Circulating pump according to claim 24, wherein said one or more seals is arranged about an axis of the connector element.

28. The Circulating pump according to claim 24, wherein said one or more seals is arranged between a housing region limiting the pumping space and the at least one connector element.

29. The Circulating pump according to claim 28, wherein said one or more seals is arranged about an opening of the at least one connector element.

* * * * *